US006145138A

United States Patent [19]

Nakamura et al.

[11] Patent Number: 6,145,138

[45] Date of Patent: Nov. 14, 2000

[54] FLUSH TOILET

[75] Inventors: Kenichi Nakamura; Toshifumi Yoneda, both of Kitakyushu, Japan

[73] Assignee: Toto Ltd., Fukuoka, Japan

[21] Appl. No.: 09/284,355

[22] PCT Filed: Oct. 14, 1997

[86] PCT No.: PCT/JP97/03706

§ 371 Date: Apr. 14, 1999

§ 102(e) Date: Apr. 14, 1999

[87] PCT Pub. No.: WO98/16696

PCT Pub. Date: Apr. 23, 1998

[30] Foreign Application Priority Data

Oct. 15, 1996 [JP] Japan ..... 8-272003
Apr. 14, 1997 [JP] Japan ..... 9-95658

[51] Int. Cl.[7] ..... E03D 11/08
[52] U.S. Cl. ..... 4/425; 4/420
[58] Field of Search ..... 4/420, 421, 425

[56] References Cited

U.S. PATENT DOCUMENTS 5,926,863 7/1999 Arita et al. ..... 4/425

FOREIGN PATENT DOCUMENTS 53-51651 12/1978 Japan .
54-172552 12/1979 Japan .
55-2135 1/1980 Japan .
2-6149 2/1990 Japan .
8-120741 5/1996 Japan .

*Primary Examiner*—Robert M. Fetsuga
*Attorney, Agent, or Firm*—Shanks & Hebert

[57] ABSTRACT

The flush toilet has a waste receipt surface section (10) of a bowl section (1) formed continuously integrally with an inner rim wall surface section (15) of the rim portion disposed at a peripheral edge of an upper opening (13) of the bowl section (1) as a curved surface; and the inner rim wall surface section (15) of the rim portion acts as a flush water passage (16) of the bowl section. The flush water passage (16) of the bowl section is further configured such that the inner rim wall surface section (15) of the rim portion is shaped in an overhanging form inclining so as to hang over inside of the bowl section (1). The flush toilet of this configuration can be cleaned with ease and kept clean in sanitation.

10 Claims, 17 Drawing Sheets

(a)

(b)

(a)

(b)

FLUSH TOILET

TECHNICAL FIELD

The present invention relates to a flush toilet of a wash-down type, a siphon type, a siphon jet type, or the like.

BACKGROUND TECHNOLOGY

Hitherto, as a main body of a flush toilet of a western type, there is generally known a flush toilet having the configuration such that a bowl section 100 is provided with a water supply and discharge system assembly 200 at its back portion, as shown in FIGS. 27(*a*) and 28(*a*).

As shown in FIGS. 27(*a*) and 28(*a*), the bowl section 100 comprises a waste receipt surface section 110, a water chamber surface section 111 located underneath the water level of a water chamber section 120, and a dry surface section 112 formed continuously with the water chamber surface section 111 and located above the water level of the water chamber section 111.

At the periphery of an upper opening of the bowl section 100 is provided a rim port-ion 130 having a predetermined width. The rim portion 130 comprises an inner peripheral wall 131, a rim rinse waterway 140, a water supply outlet 210 communicating with a water supply source not shown in the figures, a water supply conduit 220 communicating the water supply outlet 210 with the rim rinse waterway 140, and a drain path 150 communicating with a drain outlet 300.

A description will be made of the configuration of a flush water passage of the main body of the flush toilet which is known to the art.

As shown in FIG. 27(*a*), a flush toilet X1 is configured such that a number of water discharge holes 160 directed toward the waste receipt surface section 110 are disposed at a lower side surface portion of the rim rinse waterway 140. The flush water discharged from the water supply outlet 210 was passed through the water supply passage 220 to the rim rinse waterway 140. The water is then supplied from the water discharge holes 160 toward the waste receipt surface section 110 to wash the waste receipt surface section 110 away and discharged through the drain path 150 from the drain outlet 300, as shown in FIG. 27(*b*).

On the other hand, as shown in FIG. 28(*a*), a flush toilet X2 is configured such that a portion of a rim rinse waterway 140 is divided into two branch waterways to form a flush water jet passage 400. In addition to the flush water stream as described above, the flush water passes through the flush jet passage 400 from the rim rinse waterway 140 and is then discharged through a flush water jet discharge hole 410 into the drain path 150, as shown in FIG. 28(*a*). It is to be noted herein that a slit-shaped water discharge outlet 170 extending continuously over the entire periphery can be disposed on a lower side surface of a rim portion 130, as shown in FIG. 30, in place of the water discharge holes 160 formed in a large number on the lower side surface section of the rim portion 140 (as shown in FIG. 29).

Moreover, the main body of a flush toilet is generally made from porcelain that has a rough surface so that water can be absorbed therein although the amount of the water absorbed is very slight. Therefore, the porcelain body is surface finished by coating the surface thereof with a vitreous glaze in order to lose its water absorption property. This can ensure a high level of sanitation.

The flush toilets X1 and X2, however, have the following problems which have been left unsolved yet. Each of the flush toilets X1 and X2, each having the configuration of a flush water passage as described above, has a lower side surface section of the rim portion 130 structured in a complex configuration such that the rim portion 130 is protruding downwardly inside the bowl section 100 because flush water is caused to flow toward the waste receipt surface section 110. Therefore, it is difficult to coat the lower side surface section of the rim portion 130 and other sections with the glaze so that they are likely to be contaminated with germs or attached with waste product. Moreover, it is further difficult to clean the such sections because they are formed with depression that cannot be looked easily as a dead angle from the vision of the user. Therefore, it is difficult to ensure a high level of sanitation. In addition, the germs or waste product attached thereto cause a source of generating malodor.

Furthermore, the rim rinse waterway 140 has to be provided with a large number of the water discharge holes 160 or slit-shaped water discharge outlets 170 on the lower side surface section thereof in the manner as described above. Therefore, the steps for manufacturing the such flush toilets become complicated leading to a rise in costs of manufacturing the flush toilets.

DISCLOSURE OF INVENTION

Therefore, the present inventors have completed the present invention as a consequence of finding a flush toilet that can solve the problems inherent in the flush toilets as known to the art as a result of extensive research with the attempt to improve the problems prevailing in conventional flush toilets.

In other words, the present invention has the object to provide a flush toilet that ensures a coating of glaze in a boundary portion interposed between a waste receipt surface section and a rim portion upon manufacturing the flush toilet and that can be cleaned with ease in a usual way.

Further, the present invention has another object to provide a flush toilet that can perform the feature of preventing flush water from splashing outside over the flush toilet from a flush water passage of the bowl section, in addition to the features as described above.

Furthermore, the present invention has an object to provide a flush toilet that can perform the features, in addition to the features as described above, such that, for instance, neither a rim rinse waterway nor water discharge holes to be disposed at the lower side surface section of the rim rinse waterway, which are otherwise required to be disposed for the conventional flush toilets, are no longer required, thereby improving efficiency of forming the flush toilet into a given shape. Further, this invention can simplify the steps of manufacturing the flush toilets.

Moreover, the present invention has a still further object to provide a flush toilet that can perform the features, in addition to the features as described above, such that flush water can be prevented from overflowing outside from the main body of the flush toilet, even if the flush water discharged from the water discharge section expands and disperses over a wider area in the bowl section as it flows far apart from the flush water discharge section, because the portion of the bowl section having the largest curvature is shaped in an overhanging form.

The present invention has a still further object to provide a flush toilet that can perform the feature, in addition to the features as described above, such that the pressure of flush water to be discharged from the flush water discharge section can be reduced by shortening a circulating distance of the flush water.

The present invention has a still further object to provide a flush toilet that can perform the feature, in addition to the features as described above, such that a floating waste product can be discharged by a small amount of flush water.

The present invention has a still further object to provide a flush toilet that can perform the feature, in addition to the features as described above, such that flush water and a waste product can be discharged with ease under pressurized conditions.

In order to achieve the objects, the present invention provides a flush toilet which is characterized by a discharging means for discharging a main stream of flush water so as to expand and disperse over a substantially entire upper peripheral edge of the flush toilet along an inner wall surface section of the entire upper periphery of the flush toilet; a flush water passage for guiding the main stream of flush water from the discharging means; and a water passage formed gradually and continuously with the flush water passage, which is arranged so as to expand and disperse a branched stream of the flush water branched from the main stream of flush water over an substantially entire area of an inner surface section of the bowl section.

More specifically, the present invention provides a flush toilet characterized in that the flush water passage is formed as an inner wall surface section of a rim portion disposed at a peripheral edge of the upper opening of the bowl section and that the water passage is formed as a waste receipt surface section disposed continuously with the inner rim wall surface section of the rim portion. With this configuration, the common boundary portion between the waste receipt surface section and the rim portion of the flush toilet according to the present invention does not form a depressed portion which otherwise constitutes a dead angle, when looked from above, and the flush toilet according to the present invention ensures a coating of the common boundary portion with glaze upon manufacturing. Further, the flush toilet according to the present invention can be cleaned with ease in a usual way.

Further, the present invention provides a flush toilet which is characterized in that the flush water passage is shaped in an overhanging form inclining so as to hang over the inner rim wall surface section of the rim portion at its entire periphery or at a part of its periphery inside the bowl section. With this configuration, the flush toilet according to the present invention can effectively prevent the flush water discharged from the flush water passage from splashing outside over the main body of the flush toilet.

Furthermore, the present invention provides a flush toilet which is characterized by a flush water discharge section for discharging flush water into the inner rim wall surface section of the rim portion along the flush water passage. This configuration of the flush toilet according to the present invention does not require for the provision of a rim rinse waterway and flush water discharge holes disposed on a lower side surface section of the rim rinse waterway as required in conventional flush toilets. Therefore, the flush toilet according to the present invention can improve efficiency of forming flush toilets into a given shape and simplify the steps of manufacturing flush toilets.

Moreover, the present invention provides a flush toilet which is characterized in that a flush water discharge section is disposed on the interior side of the bowl section and the flush water passage of an overhanging form is disposed in the position opposite to the flush water discharge section. This configuration of the flush toilet according to the present invention can effectively prevent flush water from splashing outside over the main body of the flush toilet, even if the flush water discharged from the flush water discharge section expands and disperses over a wider area as it flows far apart from the flush water discharge section, because the portion of the bowl section having the largest curvature is shaped in an overhanging form.

In addition, the present invention provides a flush toilet which is further characterized in that the flush water discharge section is provided with two flush water discharge holes which are located separately at different positions so as to flush water in opposite directions and that the flush water discharge holes discharge the flush water in opposite directions along the flush water passage. Therefore, the flush toilet according to the present invention can shorten the distance of circulation of the flush water about the bowl section, thereby reducing a pressure of discharging the flush water.

Still further, the present invention provides a flush toilet which is characterized in that a forced flush water discharge outlet is disposed in a position above a drain path inlet disposed at the bottom portion of the bowl section and above the water level near to a water level of the water chamber of the bowl section, thereby enabling the flush water to flow into the drain path inlet from the flush water passage. Therefore, a floating waste product can be discharged by a small amount of the flush water.

Still further, the present invention provides a flush toilet which is characterized in that a flush water jet hole is disposed for jetting flush water toward a drain path inlet disposed at the bottom portion of the bowl section. This configuration of the flush toilet according to the present invention can promote the pressurized drainage of the flush water and waste product into the drain path.

In addition, the present invention provides a method of washing a flush toilet with flush water, in which the flush water is arranged so as for a main stream of the flush water and branched streams branched from the main stream of the flush water to expand and disperse over an entire area of the inner surface section of the bowl section of the flush toilet, without causing any flush water to splash outside over an upper edge portion of the flush toilet.

More specifically, the present invention provides the method for washing the flush toilet with the flush water in which the main stream of the flush water is flown so as to expand and disperse over a substantially entire periphery of the upper edge of the inner wall surface section of the upper edge portion of the flush toilet without causing the flush water to fail to splash outside over the upper edge portion of the flush toilet, the branched stream of the flush water branched from the main stream thereof is guided so as to expand and disperse over the entire area of the inner surface section of the bowl section of the toilet, and the flush water is then led to a drain path inlet. This method can discharge a waste product floating in the water with a small amount of the flush water.

Other objects, features and advantages of the present invention become apparent from the explanation of the description of this application with reference to the accompanying drawings.

BRIEF DESCRIPTION OF THE DRAWINGS

FIG. 11 is a sectional view showing the flush toilet according to the second embodiment of the present invention, with one side omitted, when taken along line I—I of FIG. 9, with.

BEST MODES FOR CARRYING OUT THE INVENTION

Figure 1:
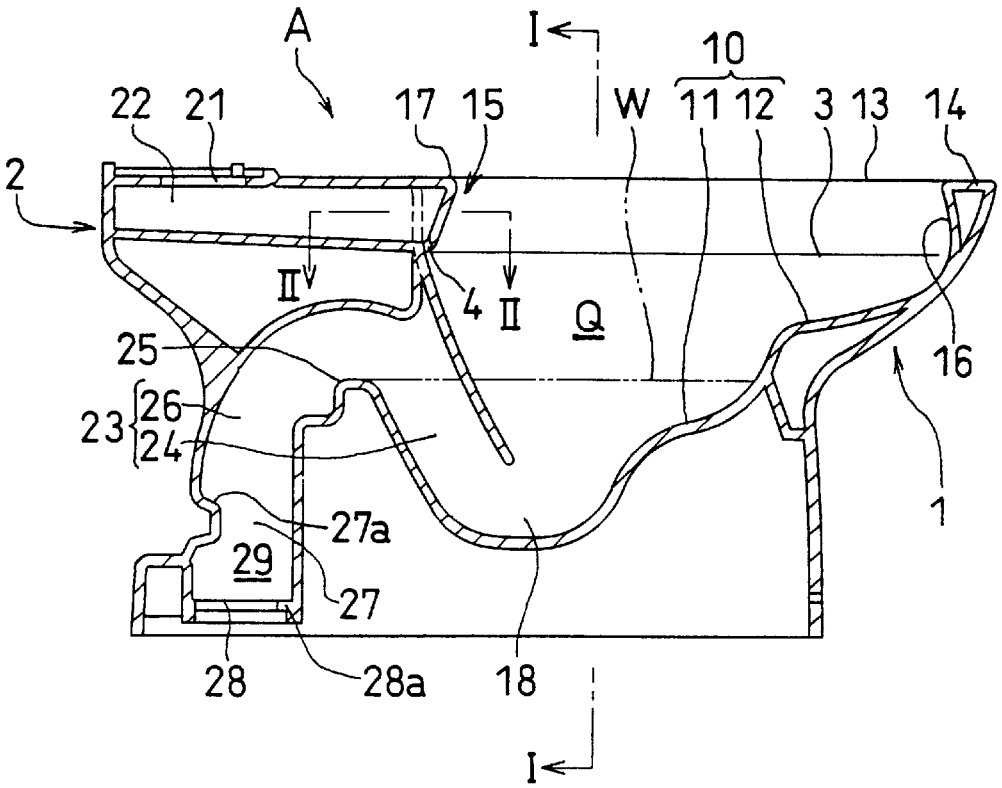
FIG. 1 is a longitudinal sectional view showing a flush toilet according,to a first embodiment of the present invention.

The present invention is concerned with a flush toilet comprising a discharging means for discharging a main stream of flush water so as to expand and disperse over a substantially entire upper peripheral edge of the flush toilet along an inner wall surface section of the entire upper periphery of the flush toilet; a flush water passage for guiding the main stream of flush water from discharging means; and a water passage formed gradually and continuously with the flush water passage, which is arranged so as to expand and disperse a branched stream of the flush water branched from the main stream of flush water over an substantially entire area of an inner surface section of the bowl section.

With this configuration, the flush toilet according to the present invention has the flush water passage formed with the inner rim wall surface section of the rim portion disposed at a periphery of the upper opening of the bowl section. Further, the water passage is formed as a waster receipt surface section formed continuously with the inner rim wall surface section of the rim portion.

More specifically, the flush toilet according to the present invention is configured such that a rim rinse waterway which is otherwise disposed inside a rim portion formed at a periphery of an upper opening of the bowl section for a conventional flush toilet is omitted, and that a flush water passage is instead disposed in an inner rim wall surface section of the rim portion to allow flush water to flow directly in the inner rim wall surface section of the rim portion. The disposition of the inner rim wall surface section of the rim portion can avoid the fact that the common boundary section between the waste receipt surface section of the bowl section and the rim portion form a depressed section that constitutes a dead angle when looked from above. This configuration ensures a sure coating of the common boundary section with glaze upon manufacturing flush toilets, and prevents a waste product or germs from adsorbing or attaching on the common boundary section. In addition, the flush toilet according to the present invention of this configuration can be cleaned with ease in a usual fashion so that a high level of sanitation can be maintained.

Further, this configuration can ensure a large inner dimension of the upper opening of the bowl section so that a depth dimension of the flush toilet can be made smaller when the inner dimension thereof is equally large.

It is preferred that the flush water passage is shaped in an overhanging form inclining so as to hang over an entire periphery or a part of the periphery of the inner rim wall surface section of the rim portion inside the bowl section. The such configuration of the flush water passage can prevent flush water from splashing outside from the flush water passage.

Further, the inner rim wall surface section of the rim portion is provided with the flush water discharge section for discharging flush water along the flush water passage so as to allow the flush water to flow in the flush water passage and circulate therein to form a circulating stream of the flush water. Therefore, the flush toilet according to the present invention does not require for the disposition of a rim rinse waterway and flush water discharge holes or slit-shaped flush water discharge outlets to be disposed on a lower side surface section of the rim rinse waterway as required by the conventional flush toilets. Further, this configuration of the flush toilet according to the present invention can improve efficiency of forming a given shape of the flush toilet and simplify the steps of manufacturing flush toilets. These features can further assist in reducing costs of production of flush toilets. In addition, the flush water can be flown along the inner rim wall surface section of the rim portion in such a state that it is controlled from above with the flush water passage in an overhanging form so as to cause no flush water to flow over the entire area of the waste receipt surface section and wash a wide area of the bowl section.

Moreover, as a working mode of the flush toilet according to the present invention, a flush water discharge section is disposed on the interior of the bowl section, and the flush water passage in the overhanging form may be disposed in the position opposite to the flush water discharge section.

More specifically, the flush water passage in the overhanging form can be disposed over the entire periphery of the inner rim wall surface section of the rim portion in the manner as described above. However, the flush water discharged from the flush water discharge section is dispersed over a wider area as it expands in a more remote distance apart from the flush water discharge section. Therefore, when the flush water discharge section is disposed on the interior side of the bowl section close to a flush water supply side thereof in order to discharge the flush water into the bowl section with a high level of efficiency, there may be caused the risk that the flush water is splashed over the upper opening of the bowl section outside the main body of the water discharge a position opposite to the flush water discharge section, if the pressure or amount of the flush water to be discharged therefrom would be too high or too large. Therefore, the such risk can be prevented effectively by providing the portion of the overhanging form in the position opposite to the flush water discharge section.

Furthermore, the flush water discharge section is provided with two flush water discharge holes which are located separately at different positions so as to discharge flush water in opposite directions and that the flush water discharge holes discharge the flush water in opposite directions along the flush water passage.

More specifically, when flush water is discharged from one direction only, the pressure of discharging the flush water should be elevated in order for the flush water to circulate over and along the entire peripheral distance of the flush water passage as a circulating stream. Therefore, there may be caused the risk that the flush water is splashed outside over the main body of the flush toilet due to a shape of the flush water passage. This configuration of the flush toilet according to the present invention can shorten the circulating distance of the flush water and reduce the pressure of discharging the flush water. As a consequence, it can ensure a prevention of the flush water from splashing over and outside the flush toilet.

Further, the flush toilet according to the present invention may be provided with a forced flush water discharge outlet in the position above a drain path inlet disposed at the bottom of the bowl section and above the water level near to the water level of the water chamber section in the bowl section so as to promote the flow of the flush water into the drain path inlet from the flush water passage. This configuration of the flush toilet according to the present invention allows a floating waste product in the water to be discharged with a small amount of the flush water and produces the effect of saving an amount of the flush water. Moreover, this configuration can also prevent the flush water from splashing outside upon discharging and further reduce noise upon flushing because the opening of the forced flush water discharge outlet is located below the water level of the water chamber when water is flushed to raise the water level in the bowl section upon discharging the water therein.

In addition, the flush toilet according to the present invention having the configurations as described above may also be a flush toilet of a siphon jet type in which a flush water jet hole is disposed so as to jet flush water toward the drain path inlet disposed at the bottom portion of the bowl section. Therefore, the flush toilet according to the present invention of such a siphon jet type can achieve the higher effect of saving water because it can promote the discharging of the flush water and waste product into a drain path under pressurized conditions, while possessing the action and effects as described above.

With the flush toilet of the configurations as described above, the method for washing the flush toilet can be provided, in which the flush water can be expanded and dispersed over an entire area of the inner surface section of the bowl section of the toilet by using the main stream of the flush water and the branch streams branched from the main stream thereof.

The present invention will be described in more detail by way of embodiments and examples with reference to the accompanying drawings.

(First Embodiment)

Figure 2:
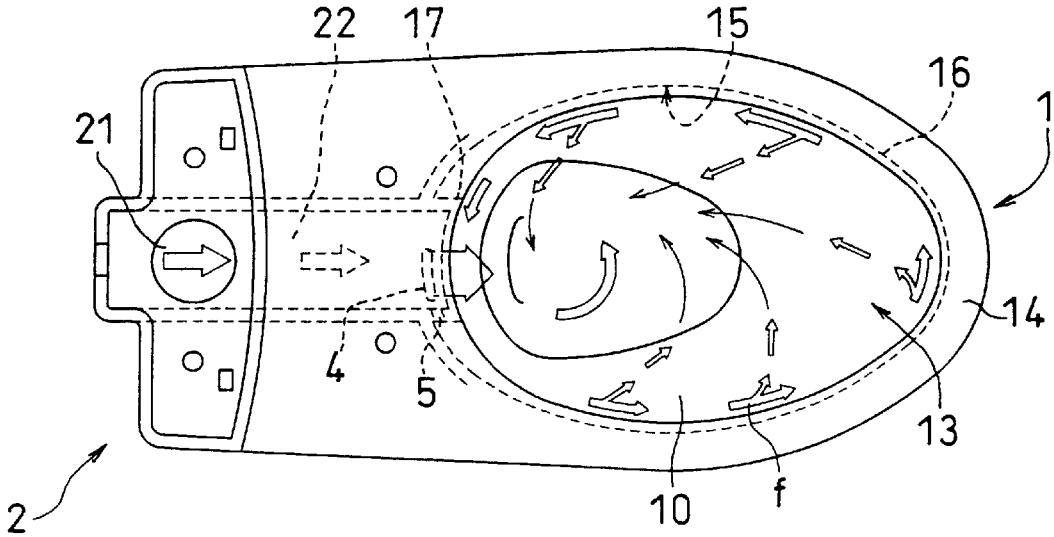
FIG. 2 is a plan view showing the flush toilet according to the first embodiment of the present invention.

FIGS. 1 to 4 indicate a flush toilet A according to the first embodiment of the present invention. The flush toilet A is formed from porcelain with glaze coated thereon. As shown in FIGS. 1 and 2, the flush toilet A comprises a bowl section 1 at its front portion and a flush water supply and discharge section 2 at its rear portion.

The bowl section 1 is configured in such a manner that flush water is stored at a lower portion of its inner space Q and that a waste receipt surface section is located at a front portion thereof and formed in such a bowl shape as receiving a waste product. The waste receipt surface section comprises a water chamber surface section 11 positioned so as to become under the water level of a water chamber W and a dry surface section 12 located above the water level of the water chamber W. The dry surface section 12 is formed in a shape such as a step-like shape which extends gradually and continuously toward the water chamber surface section 11.

Further, the bowl section 1 is provided with a rim portion 14 having a predetermined width at a peripheral edge of an upper opening 13 thereof.

The flush water supply and discharge section 2 comprises a flush water supply hole 21 communicating with a flush water tank, although not shown in the drawings, a water passage 22 communicating with the flush water supply hole 21, and a drain path 23 disposed at a lower portion of the water passage 22. The drain path 23 further comprises a rising path 24 communicating with a drain path inlet 18 disposed at the bottom portion of the waste receipt surface section, and a longitudinal tube 26 communicating with and coupled to a bank portion 25 formed at an upper end portion of the rising path 24.

As shown in FIG. 1, the longitudinal tube 26 of the drain path 23 comprises a first diaphragm portion 27 disposed on an end side thereof and a second diaphragm portion 28 disposed on a side downstream than the first diaphragm portion 27. The first diaphragm portion 27 is provided with a projecting shelf portion 27*a* on which the first diaphragm portion 27 is formed. On the other hand, the second diaphragm portion 28 is provided with a projecting shelf portion 28*a* on which the second diaphragm portion 28 is formed.

For the flush toilet A of the above configuration, the characteristic features of the present invention reside in that a discharging means is disposed so as to discharge the main stream of the flush water so as to expand and disperse over a periphery of the toilet, that is, over a substantially entire periphery of the bowl section 1 along the inner wall surface section of the bowl section 1, a flush water passage 16 is disposed so as to guide the main stream of the flush water discharged from the discharging means, and a water passage 10 is disposed so as to expand and disperse a branch stream branched from the main stream thereof over a substantially entire area of the inner surface section of the bowl section 1.

In this configuration, the flush water passage 16 is formed as an inner rim wall surface section 15 of the rim portion disposed at the peripheral edge of the upper opening of the bowl section 1, and the water passage 10 is formed as a waste receipt surface section disposed continuously with the rim inner wall surface section 15 of the rim portion.

Figure 3:
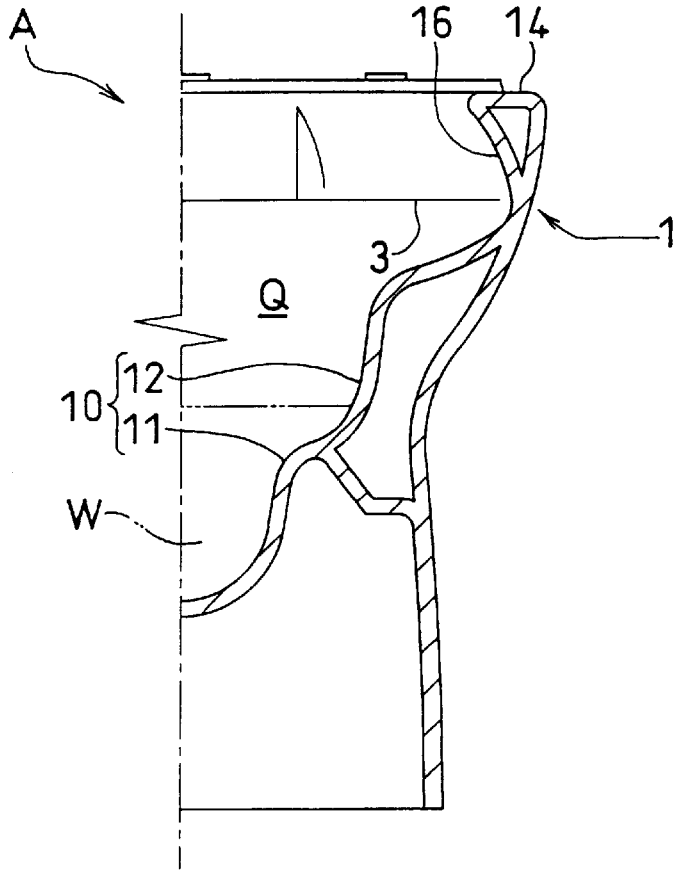
FIG. 3 is a sectional view showing the flush toilet, with one side omitted, when taken along line I—I of FIG. 1.
Figure 27:
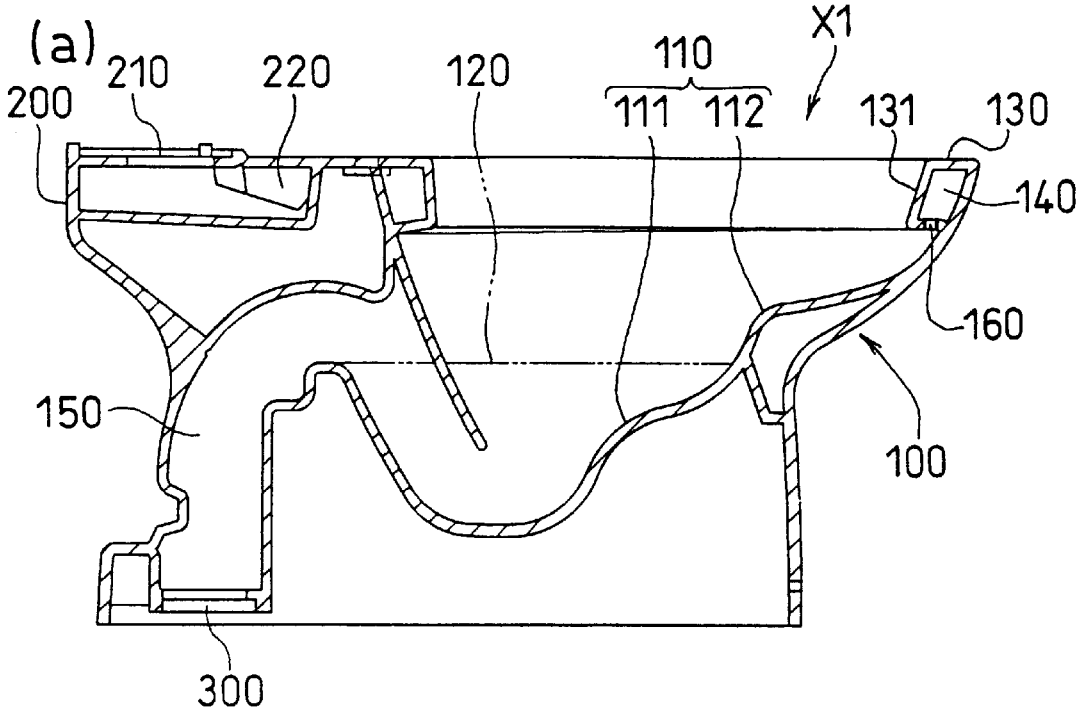
FIG. 27 is a longitudinally sectional view showing a conventional flush toilet
Figure 27:
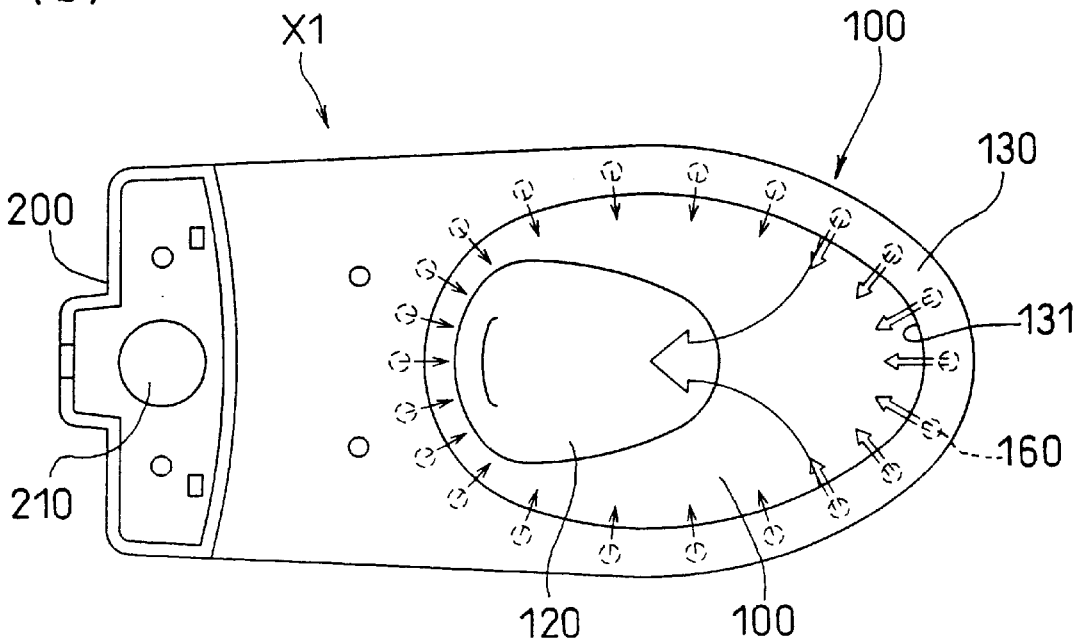
Figure 28:
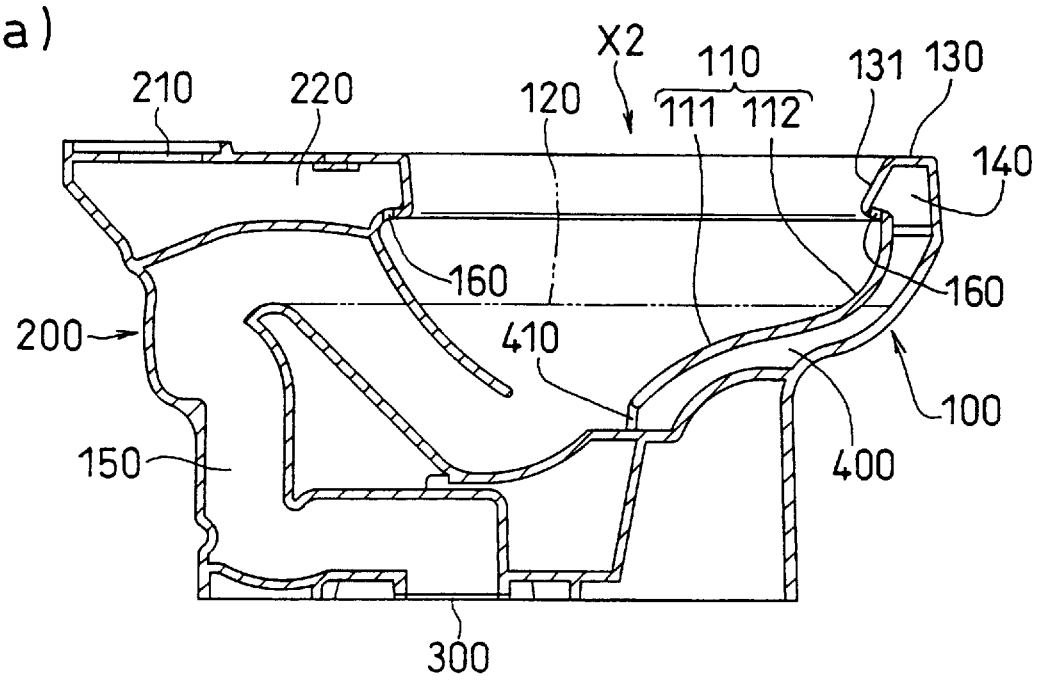
FIG. 28 is a longitudinally sectional view showing a conventional flush toilet in one aspect.
Figure 28:
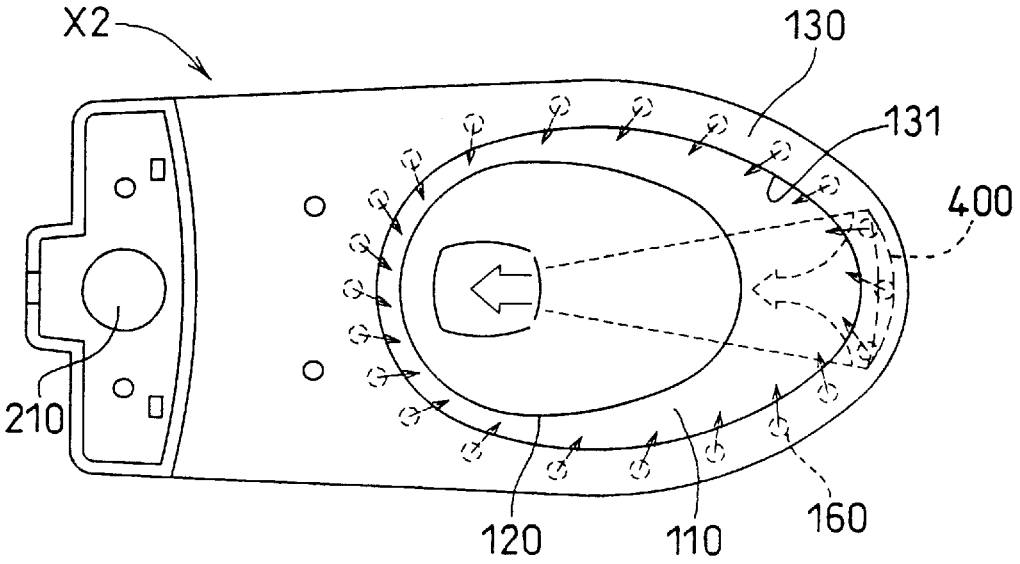
Figure 29:
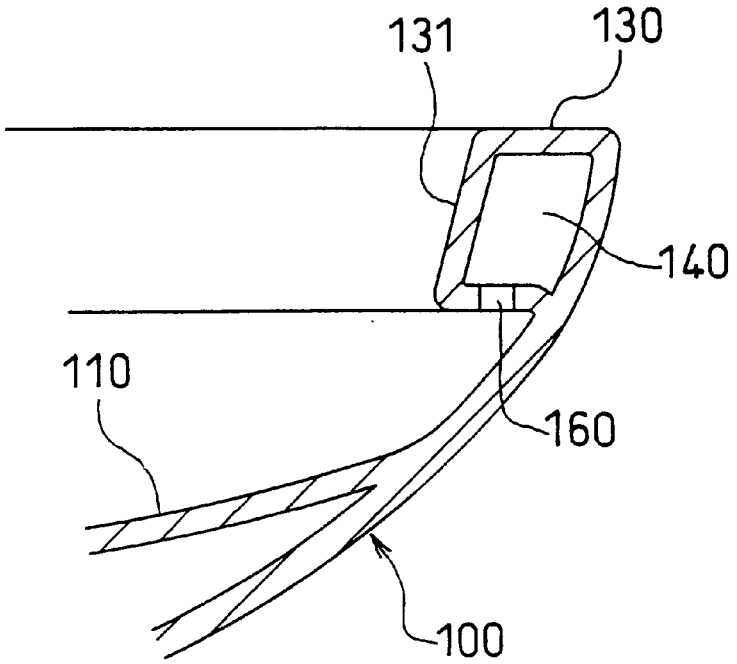
FIG. 29 is a schematic view showing a water discharge hole of the conventional flush toilet.
Figure 30:
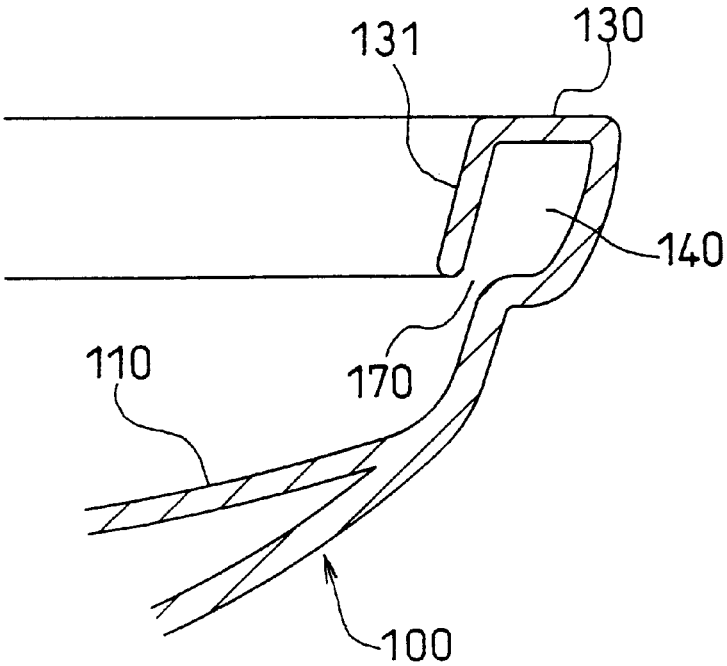
FIG. 30 is a schematic view showing a slit-shaped water discharge section of the conventional flush toilet.

More specifically, as shown in FIGS. 1 and 3, the flush water passage 16 in the overhanging form is shaped so as to rise smoothly and continuously at a sharp angle from the dry surface section 12 of the water passage 10 acting as the waste receipt surface section and to incline in the direction opposite to the direction in which an inner peripheral wall of the rim portion of the conventional flush toilet (as shown in FIGS. 27(*a*) and 28(*a*)). Moreover, the flush water passage 16 is formed so as to allow a common boundary section 3 located between the flush water passage 16 and the dry surface section 12 to be viewed from the above.

As the configuration as described above can prevent the common boundary section 3 interposed between the water passage 10 of the bowl section 1 and the rim portion 14 from becoming a dead angle when looked from above, the common boundary section 3 can be coated with glaze with certainty during manufacturing the flush toilet. Therefore, adsorption and attachment of solid waste and germs can be prevented effectively. Moreover, the flush toilet having the such configuration can be cleaned easily in a usual way, and a clean state of the flush toilet can be kept.

Further, the inner rim wall surface section 15 of the rim portion is provided with a flush water discharge section for discharging flush water so as to flow along the flush water passage 16. In this embodiment, the flush water discharge section is disposed on the interior side of the bowl section 1.

Figure 4:
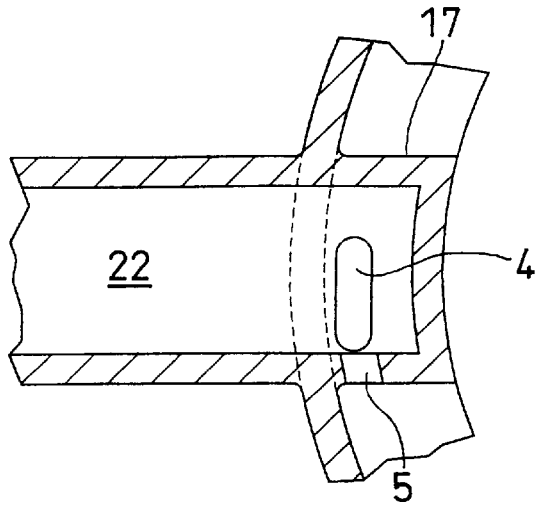
FIG. 4 is a partially omitted, sectional view showing the flush toilet according to the first embodiment of the present invention, when taken along line II—II of FIG. 1.

More specifically, a portion of the inner rim wall surface section 15 of the rim portion acting as a partition wall between the water passage 22 and the inner space Q of the bowl section 1 is formed as a projection portion 17 which projects toward the side of the inner space Q. As shown in FIG. 4, the projection portion 17 is provided with a flush water discharge section which comprises with a downwardly discharging opening 4 for discharging flush water downwardly and a transversely discharging opening 5 for discharging flush water transversely. The downwardly discharging opening 4 and the transversely discharging opening 5 are disposed so as to communicate each with the water passage 22. The transversely discharging opening 5 discharges the flush water transversely so as to flow along the flush water passage 16.

Therefore, as shown in FIG. 2, the flush water passage 22 of the bowl section constitutes a flush water passage acting as a circulating path f of the flush water. Thus, unlike the conventional flush toilet as shown in FIGS. 27 to 30, the resulting flush toilet does not require for the provision of the rim rinse waterway 140 and the flush water discharge holes 160 or the slit-shaped flush water discharge outlet 170 to be disposed on the lower side surface section of the rim rinse waterway 140. This can improve efficiency of forming the shape of the flush toilet and simplify the steps of manufacturing the flush toilets, thereby reducing production costs.

Moreover, the flush toilet according to the present invention enables the flush water to flow along the inner rim wall surface section 15 of the rim portion in such a state that the flush water is controlled so as to splash outside over the bowl section from above with the flush water passage 16 disposed in an overhanging form hanging over inside the bowl section. Therefore, the flush water can be dispersed over a wide area of the water passage 10 acting as the waste receipt surface section and wash a wide area of the bowl section.

Now, a description will be made of the washing action of the flush toilet A.

When flush water has been supplied, for instance, by operating a lever or a press button after stools, the flush water flows from the flush water supply hole 21 into the water passage 22, and it is then discharged through the downward discharging opening 4 and the transversely discharging opening 5 toward the waste receipt surface section, i.e., the water passage 10.

At this time, the flush water from the downward discharging opening 4 is discharged in a generally perpendicular direction toward the water chamber W and acts in the direction of pushing a waste product excreted in the water chamber W into the drain path 23. On the other hand, the flush water from the transversely discharging opening 5 as a main stream of the flush water washes the waste receipt surface section, i.e., the water passage 10 containing the dry surface section 12 by guiding a branch stream branched from the main stream thereof with the water passage 10, while circulating around a peripherally circulating passage f having a flow as a major stream on the common boundary section 3 between the flush water passage 16 and the dry surface section 12. At the same time, the flush water discharged from the transversely discharging opening 5 causes an occurrence of a circulating stream in the water chamber W, and a whirlpool is caused to occur at a generally central portion of the water chamber W, thereby allowing the waste product floating in the water to be drawn toward the center of the water chamber W.

Therefore, the flush water can wash the entire area of the inner surface section containing an area near to the rim portion 14 of the bowl section 1 and keep the flush toilet A clean. Moreover, the flush water as a circulating stream is caused to flow in such a state that it cannot flow upwardly with the flush water passage 16 and flows downwardly so that it does not splash outside over the main body of the flush toilet. The processing water of the flush water, in which the waste product is swallowed up, flows from the drain path inlet 18 into the rising path 24 and overflows the bank portion 25 formed at an end portion of the rising path 24 into the longitudinal tube 26. The over flown processed water is then allowed to strike the projecting shelf portion 27*a* of the first diaphragm portion 27 and the projecting shelf portion 28*a* of the second diaphragm portion 28, each disposed on the longitudinal tube 26, thereby causing a space 29 between the first diaphragm portion 27 and the second diaphragm portion 28 to form a water seal and as a result inducing a siphon. The action of the siphon induced in the drain path 23 causes the waste product on the waste receipt surface section to be discharged outside from the flush toilet.

Figure 5:
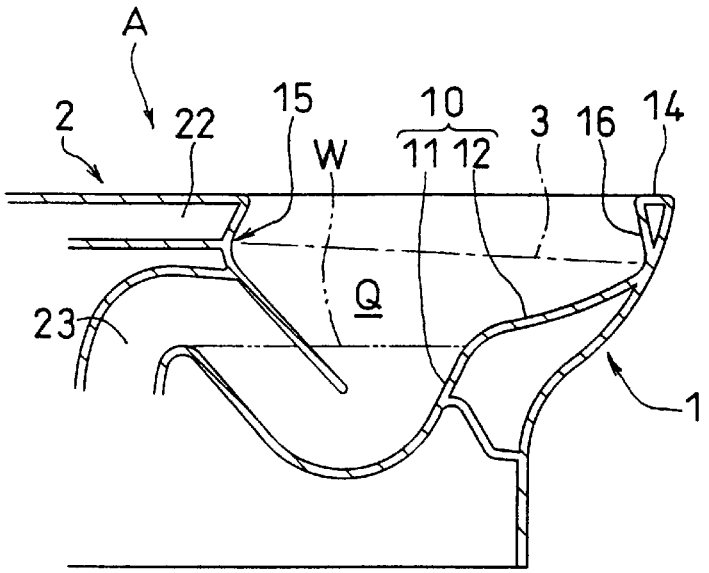
FIG. 5 is a schematic view showing a variation of the flush toilet according to the first embodiment of the present invention.
Figure 6:
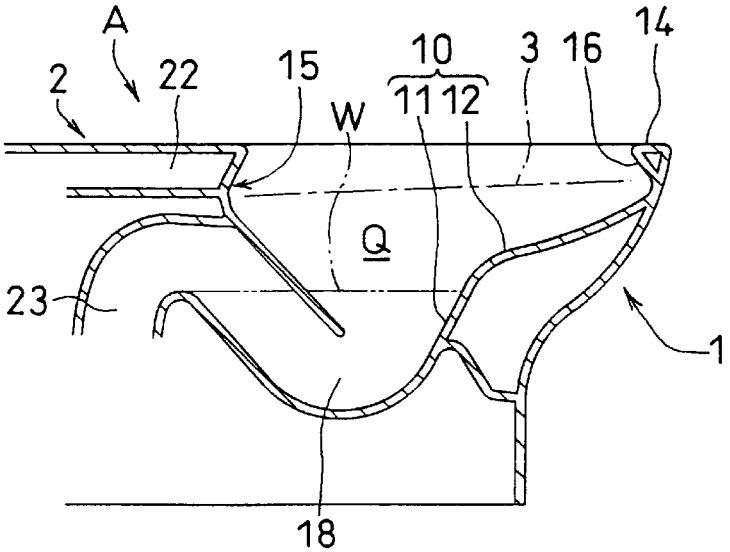
FIG. 6 is a schematic view showing another variation of the flush toilet according to the first embodiment of the present invention.
Figure 7:
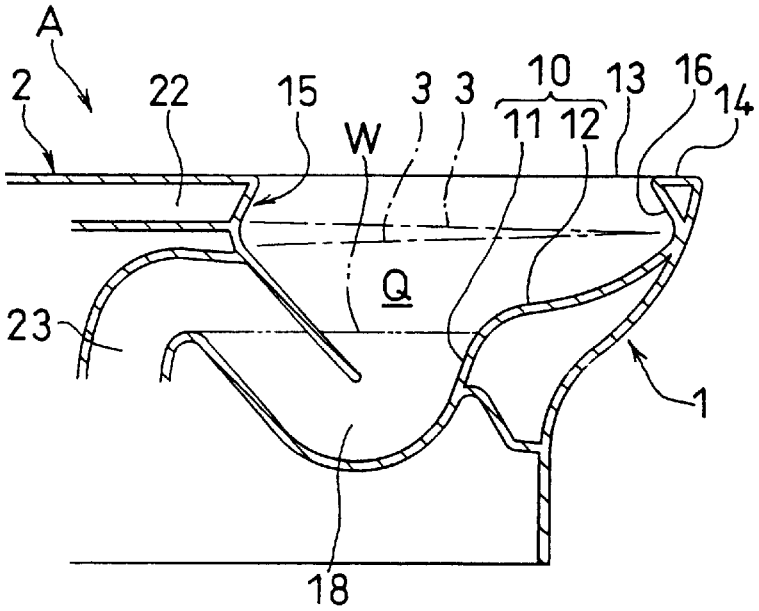
FIG. 7 is a view showing a further variation of the flush toilet according to the first embodiment of the present invention.
Figure 8:
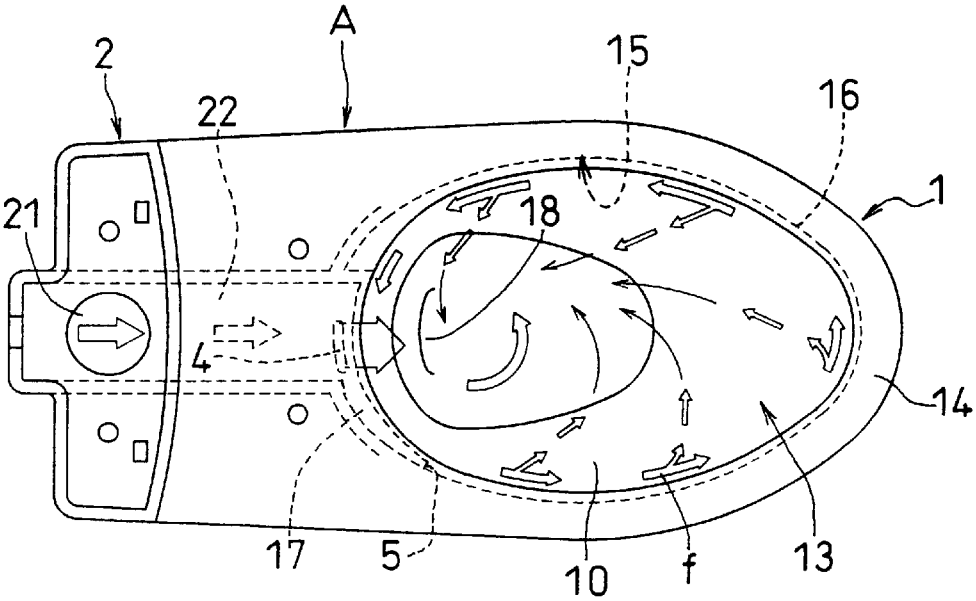
FIG. 8 is a schematic view showing a still further variation of the flush toilet according to the first embodiment of the present invention.

There are variations of the flush toilet A according to the first embodiment of the present invention, as shown in FIGS. 5 to 8. In the flush toilet A according to the variation of the first embodiment of the present invention as shown in FIG. 5, the common boundary section 3 between the flush water passage 16 and the dry surface section 12 is disposed inclining downwardly as it extends toward the front portion of the bowl section 1 (toward the right in the drawing). The flush toilet according to another variation as shown in FIG. 6 is configured such that the common boundary section 3 is disposed inclining upwardly as it extends toward the front portion of the bowl section 1 in a manner opposite to the flush toilet of FIG. 5. The flush toilet according to the further variation as shown in FIG. 7 is configured such that the common boundary section 3 is disposed so as to gradually incline downwardly along the direction of circulating the flush water. Further, the flush toilet according to the still further variation as shown in FIG. 8 has the projection portion 17 forming the downward discharging opening 4 and the transversely discharging opening 5 disposed extending in the discharging direction.

(Second Embodiment)

Figure 9:
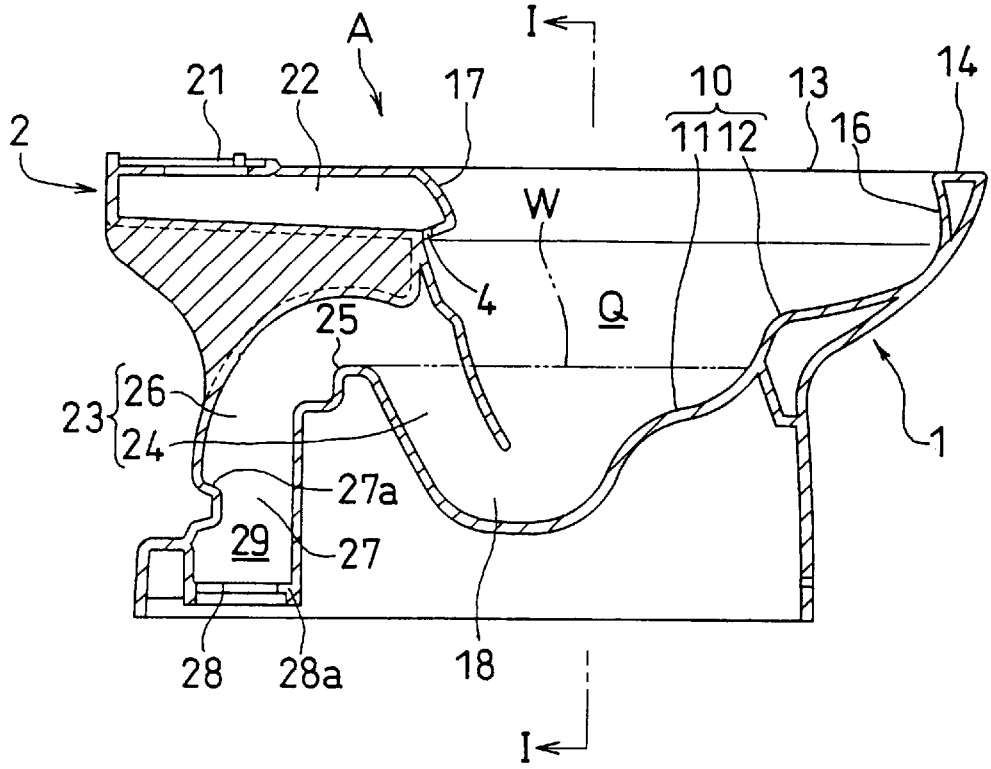
FIG. 9 is a longitudinally sectional view showing a flush toilet according to a second embodiment of the present invention.
Figure 10:
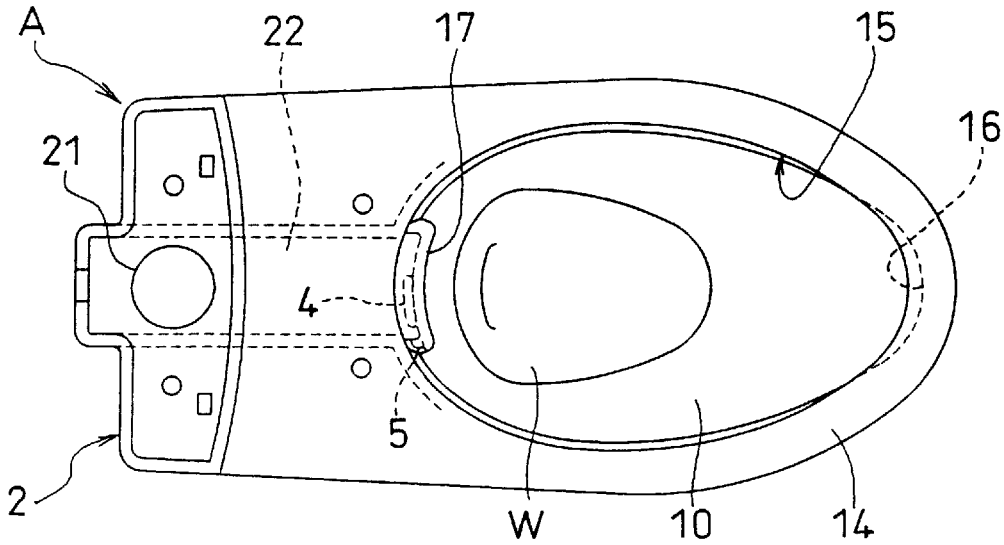
FIG. 10 is a plan view showing the flush toilet according to the second embodiment of the present invention.
Figure 11:
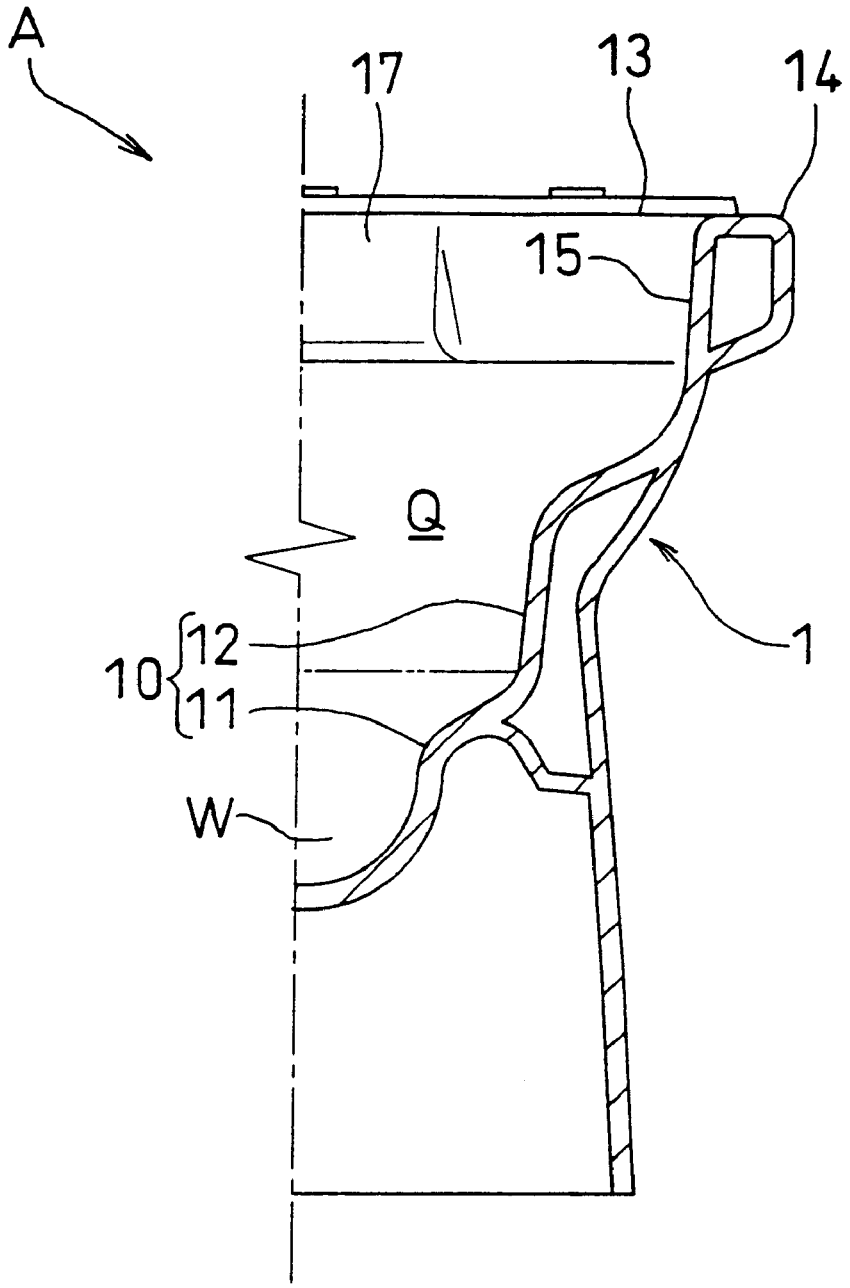

Next, a description will be made of the flush toilet A according to the second embodiment of the present invention with reference to FIGS. 9 to 11. The flush toilet A of the second embodiment is provided with the same reference numerals for the structuring elements identical to those of the flush toilet A of the first embodiment as described above.

Although the flush toilet A of the previous embodiment has the flush water passage 16 configured in an overhanging form over the entire periphery of the inner rim wall surface section 15 of the rim portion, the flush toilet A of this embodiment is configured such that a portion of the inner rim wall surface section 15 of the rim portion is shaped in an overhanging form. Therefore, the portion of the flush water passage 16 is shaped in an overhanging form, which is located in the position opposite to the flush water discharge section disposed on the interior side of the bowl section 1.

More specifically, the projection portion 17 with the downward discharging opening 4 and the transversely discharging opening 5 formed therewith, which constitute the flush water discharge section, is provided on the interior side of the bowl section 1 in substantially the same manner as the flush toilet of the first embodiment. Further, the inner rim wall surface section 15 of the rim portion with the projection portion 17 formed therewith is configured so as to comprise a downwardly sloping surface of a usual shape, and a portion near to the top end side (the right end portion in the drawing) of the bowl section 1 corresponding to the projection portion 17 is shaped in an overhanging form.

With this configuration of the flush toilet A of the second embodiment, the flush water discharged from the transversely discharging opening 5 disposed in the interior of the bowl section 1 is arranged so as to expand and disperse over a wider area of the inner side surface section of the bowl section as the flush water flows far apart from the transversely discharging opening 5. The flush toilet A of the second embodiment, however, is configured such that the portion of the bowl section having the largest curvature where the flush water is considered likely to splash outside over the main body of the flush toilet, that is, the front end portion of the bowl section 1, is provided with the flush water passage 16 in order to prevent the flush water from splashing over the main body of the flush toilet. The other configurations and the action of a siphon for discharging a waste product outside the flush toilet according to the flush toilet of the second embodiment are substantially identical to those of the flush toilet of the first embodiment, so that a duplicate description is omitted therefrom.

With the above configuration, the flush toilet of this embodiment can achieve substantially the same effects as achieved by the flush toilet of the first embodiment. In addition to those effects, the flush toilet of the second embodiment can further achieve the effect that the flush toilet can simplify the steps of manufacturing flush toilets because only the rim portion 14 with the flush water passage 16 provided therewith is formed by a split mold, while the other portions of the rim portion 14 can be formed by the same mold as the bowl section 1. Therefore, the steps of manufacturing flush toilets can be simplified. On the other hand, upon manufacturing the flush toilet of the first embodiment, the rim portion 14 should be formed by a mold separate from a mold for the bowl section 1, and the rim portion 14 is then joined with the bowl section 1 by adhesive.

Figure 12:
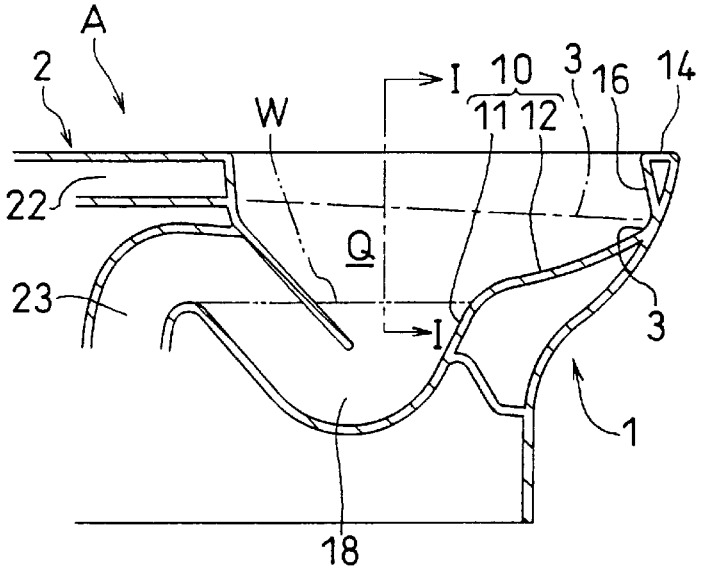
FIG. 12 is a schematic view showing a variation of the flush toilet according to the second embodiment of the present invention.
Figure 13:
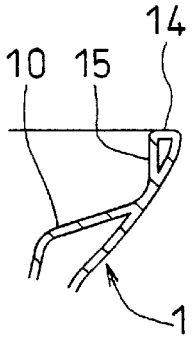
FIG. 13 is a sectional view showing the flush toilet taken along line I—I of FIG. 12.
Figure 14:
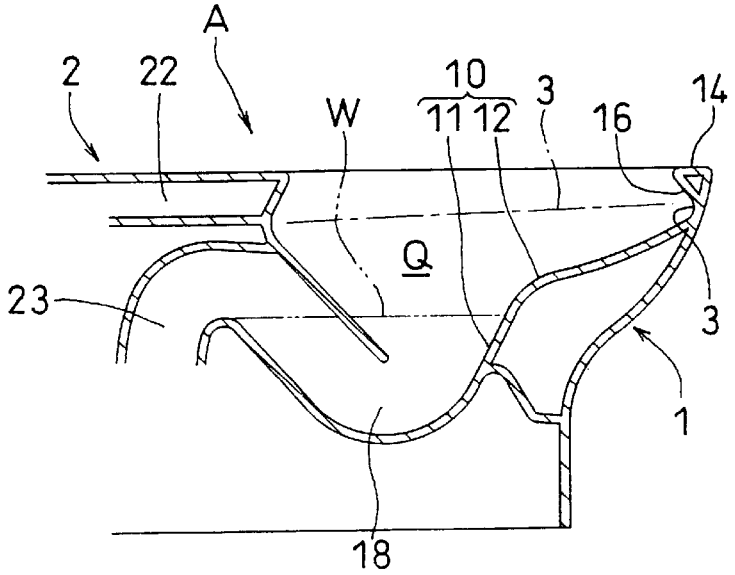
FIG. 14 is a schematic view showing another variation of the flush toilet according to the second embodiment of the present invention.
Figure 15:
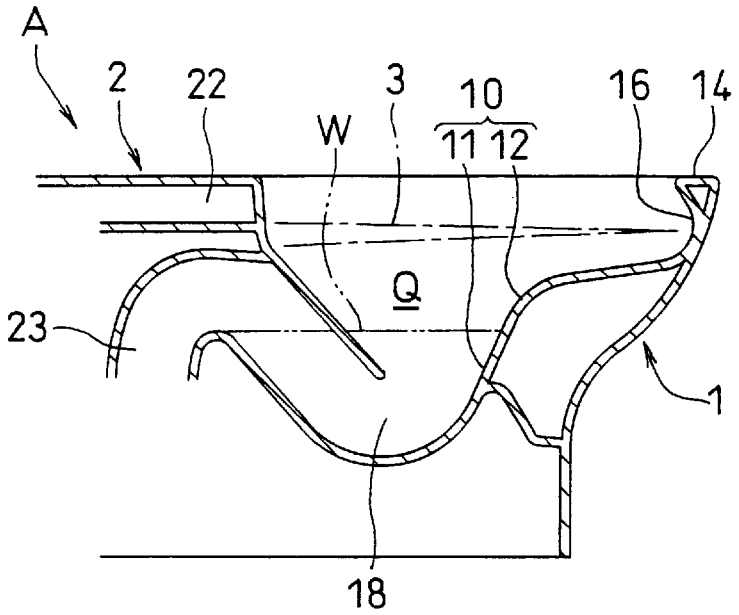
FIG. 15 is a schematic view showing a further variation of the flush toilet according to the second embodiment of the present invention.
Figure 16:
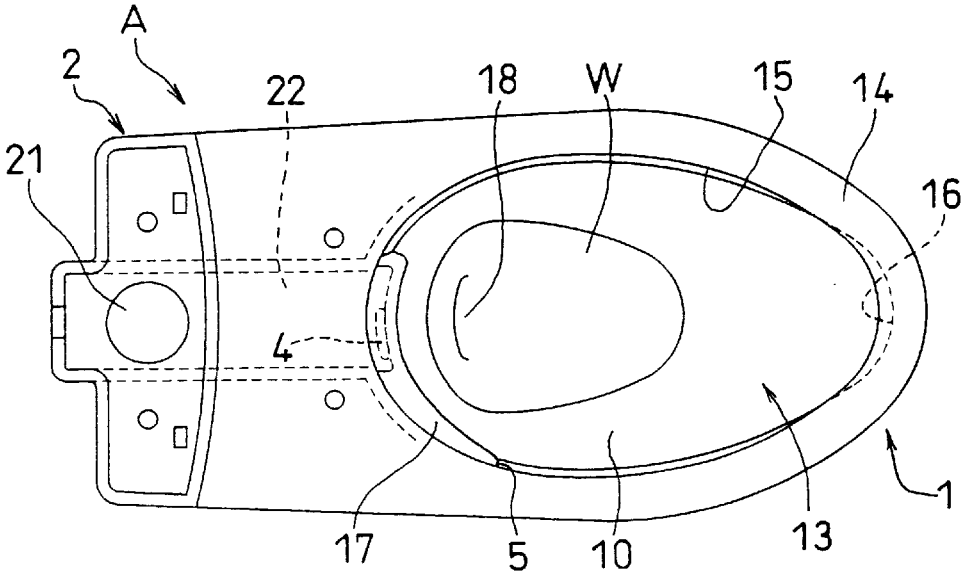
FIG. 16 is a schematic view showing a still further variation of the flush toilet according to the second embodiment of the present invention.

There can be proposed variations of the flush toilet A according to the second embodiment of the present invention, as shown in FIGS. 12 to 16. More specifically, in the flush toilet A according to the variation of the second embodiment of the present invention as shown in FIG. 12, the common boundary section 3 between the inner rim wall surface section 15 of the rim portion 14 and the dry surface section 12 is disposed inclining downwardly as it extends toward the front portion of the bowl section 1 (toward the right in the drawing). On the other hand, the common boundary section 3 between the flush water passage 16 disposed on the front end side of the bowl section 1 and the dry surface section 12 is located in the position below the transversely discharging opening 5. Moreover, the flush toilet according to another variation as shown in FIG. 13 is configured such that the inner rim wall surface section 15 of the rim portion 14 is formed as a generally vertical surface at a portion other than the portion near to the top end side of the bowl section 1. The flush toilet according to the further variation as shown in FIG. 14 is configured such that the common boundary section 3 interposed between the inner rim wall surface section 15 of the rim portion 14 and the dry surface section 12 is disposed so as to gradually incline upwardly as it extends farther toward the front of the bowl section 1 (toward the right in the drawing). Therefore, the common boundary section 3 interposed between the flush water passage 16 disposed on the front end side of the bowl section 1 and the dry surface section 12 is located in a position above the transversely discharging opening 5. Furthermore, in the flush toilet according to the still further variation as shown in FIG. 15, the common boundary section 3 interposed between the inner rim wall surface section 15 of the rim portion 14 and the dry surface section 12 is disposed so as to gradually incline downwardly along the direction of circulation of the flush water. In addition, the flush toilet according to the still further variation as shown in FIG. 16 has the projection portion 17 with the downward discharging opening 4 and the transversely discharging opening 5 provided therein is formed extending in the direction of discharging flush water.

It is to be noted herein, however, that the portion at which the flush water passage 16 is shaped in an overhanging form is not limited to the portion as described above in connection with the second embodiment, and any appropriate portion can be shaped in such an overhanging form.

(Third Embodiment)

A description will then be made of the flush toilet A according to the third embodiment with reference to FIGS. 17 to 20. The flush toilet of the third embodiment is configured such that the flush water passage 16 is shaped in an overhanging form inclining so as to hang over the entire periphery of the inner rim wall surface section 15 of the rim portion in substantially the same manner as the flush toilet of the first embodiment. On the other hand, the flush toilet of the third embodiment differs from the flush toilet of the first embodiment in that a forced flush water discharge outlet 40 is disposed in the position above the drain path inlet 18 disposed in the bottom portion of the bowl section 1 and above the water level close to the water level of the water chamber W in the bowl section 1. This configuration can promote a flow of the flush water into the drain path inlet 18 from the flush water passage 16. The structuring elements of the flush toilet of the third embodiment identical to those of the first embodiment are provided with the identical reference numerals.

Figure 17:
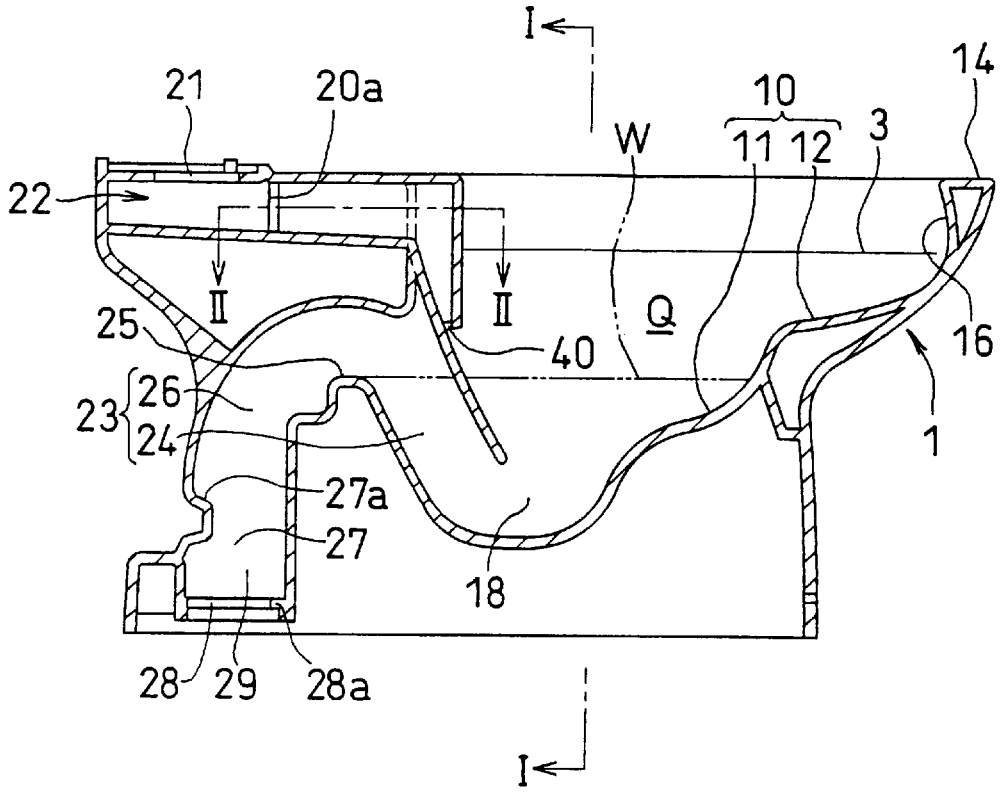
FIG. 17 is a longitudinally sectional view showing a flush toilet according to a third embodiment of the present invention.
Figure 18:
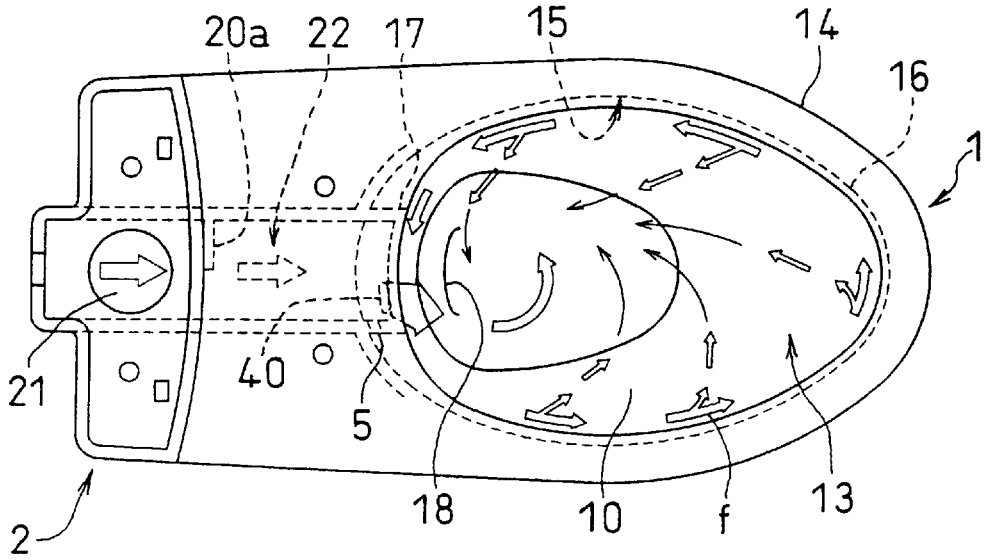
FIG. 18 is a plan view showing the flush toilet according to the third embodiment of the present invention.
Figure 19:
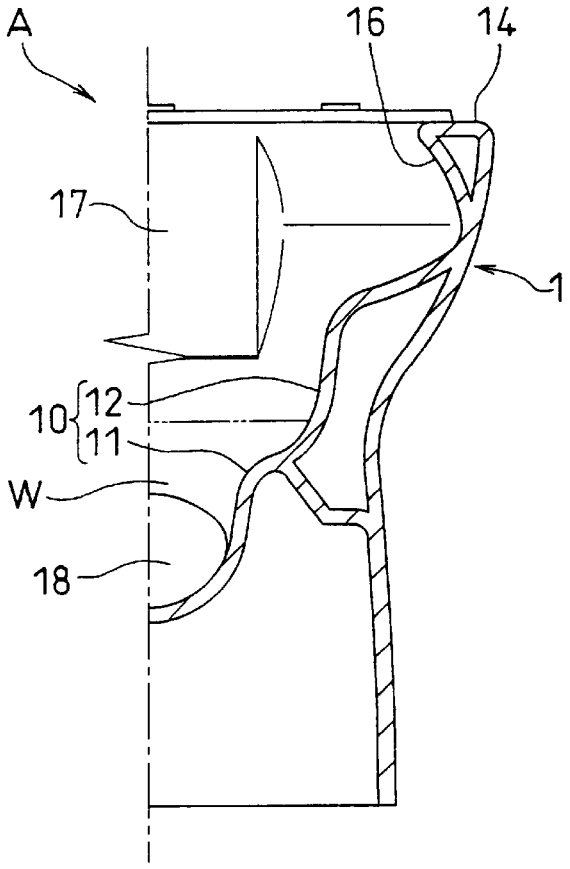
FIG. 19 is a sectional view showing the flush toilet according to the third embodiment of the present invention, with one side omitted, when taken along line I—I of FIG. 17.

More specifically, as shown in FIG. 17, the flush toilet according to the third embodiment is configured such that the projection portion 17 is formed by projecting a portion of the inner rim wall surface section 15 of the rim portion, which constitutes a partition wall between the water passage 22 and the inner space Q of the bowl section 1, toward the side of the inner space Q. Further, the projection portion 17 has its front end extending downwardly to approach to the water level of the water chamber W, and the forced flush water discharge outlet 40, which corresponds to the downward discharging opening 4 of the flush toilet of the first embodiment, is disposed in the position in which the projection portion 17 is deviated toward one side of the front end portion.

Figure 20:
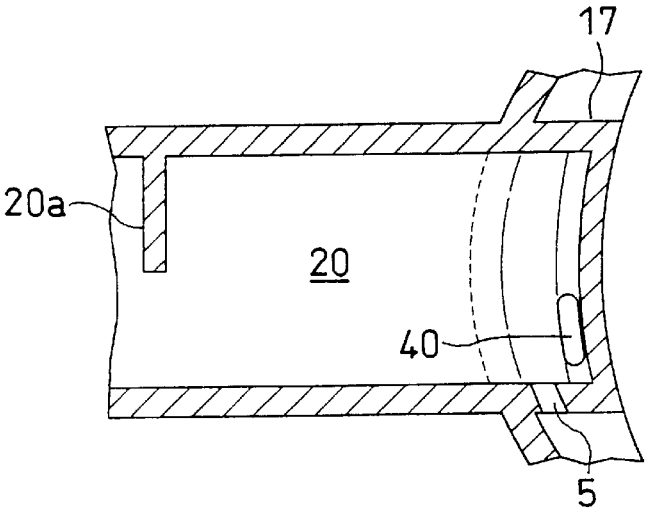
FIG. 20 is a partially omitted, sectional view showing the flush toilet according, to the third embodiment of the present invention, when taken along line II—II of FIG. 17.

Further, as shown in FIG. 20, the flush toilet of this embodiment is configured such that a water path diaphragm portion 20*a* is disposed in an intermediate position of the water passage 22, which projects through a plate member from a side wall opposite to the forced flush water discharge outlet 40 and that a rate of the amount of flush water to be supplied from a flush water hole 21 can be adjusted. It should be noted herein that the water path diaphragm portion 20*a* may be disposed in an optional way. With this configuration, when the flush water is supplied after spools, the rate of the amount of the flush water is adjusted by the water path diaphragm portion 20*a* upon flowing from the flush water hole 21 into the water passage 22, and the flush water is then discharged onto the waste receipt surface section constituting the water passage 10 from the forced flush water discharge outlet 40 and the transversely discharging opening 5.

The flush water from the forced flush water discharge outlet 40 is discharged toward the water chamber W in a generally vertical direction and flows in the direction in which the waste product excreted into the water chamber W is forced into the drain path 23. On the other hand, the flush water from the transversely discharging opening 5 is arranged so as for the branch stream branched from the main stream thereof to be guided to the water passage 10 and wash the waste receipt surface section containing the dry surface section 12, while the main stream of the flush water circulates a peripherally circulating passage f as a major flow of the flush water through which the flush water flows on the common boundary section 3 between the flush water passage 16 and the dry surface section 12. At the same time, the flush water from the transversely discharging opening 5 causes a circulating current to occur in the water chamber W and allows the floating waste product to draw nearly in the center of a whirlpool. The waste product is then discharged effectively into the drain path inlet 18 by the aid of the force of the flush water from the forced flush water discharge outlet 40 as a processing water with the waste product swallowed up in the flush water.

At this time, the forced flush water discharge outlet 40 is disposed in the position close to the water level of the water chamber W so that it becomes positioned in the water of the water chamber W when the water level of the water chamber W arises by supplying the flush water. This can prevent the flush water from splashing outside over the main body of the flush toilet.

It is further to be noted herein that in the flush toilet according to the third embodiment, the other structures and the action of the siphon for discharging a waste product outside the flush toilet are substantially the same as those of the flush toilet of the first embodiment. A duplicate description of the equal elements and action is omitted therefrom accordingly.

With the configuration as described above, the flush toilet A according to the third embodiment of the present invention can wash an entire area of the inner side surface section containing the portion near to the rim portion 14 of the bowl section 1 and keep the bowl section 1 clean. Further, the disposition of the forced flush water discharge outlet 40 enables a waste product to be discharged effectively. Moreover, the water path diaphragm portion 20*a* disposed in the water passage 22 allows an adjustment of the rate of the amount of the flush water so that the waste product can be discharged in an efficient way with a smaller amount of the flush water.

(Fourth Embodiment)

A further description will be made of a flush toilet B according to the fourth embodiment of the present invention with reference to FIGS. 21 to 23. In the flush toilet B of this embodiment, its structuring elements equal to that of the first embodiment are provided with equal reference numerals.

The flush toilet B of this embodiment is characterized in that the flush water discharge section is provided with two flush water discharge outlets 51 and 52 and that the flush water discharge outlets 51 and 52 are located in different positions so as to discharge flush water in opposite directions and flow the flush water in opposite directions along the flush water passage 16.

This configuration of the flush toilet B of the fourth embodiment can shorten the peripheral distance of circulation of the flush water in the bowl section 1, thereby reducing the pressure of the flush water and preventing the flush water from splashing outside over the main body of the flush toilet. Further, the present invention can provide the flush toilet B of a siphon jet type flush toilet B which can force a waste product into the drain path 23 and discharge the waste product with a small amount of the flush water in an efficient way by mounting a flush water jet passage 19.

Figure 21:
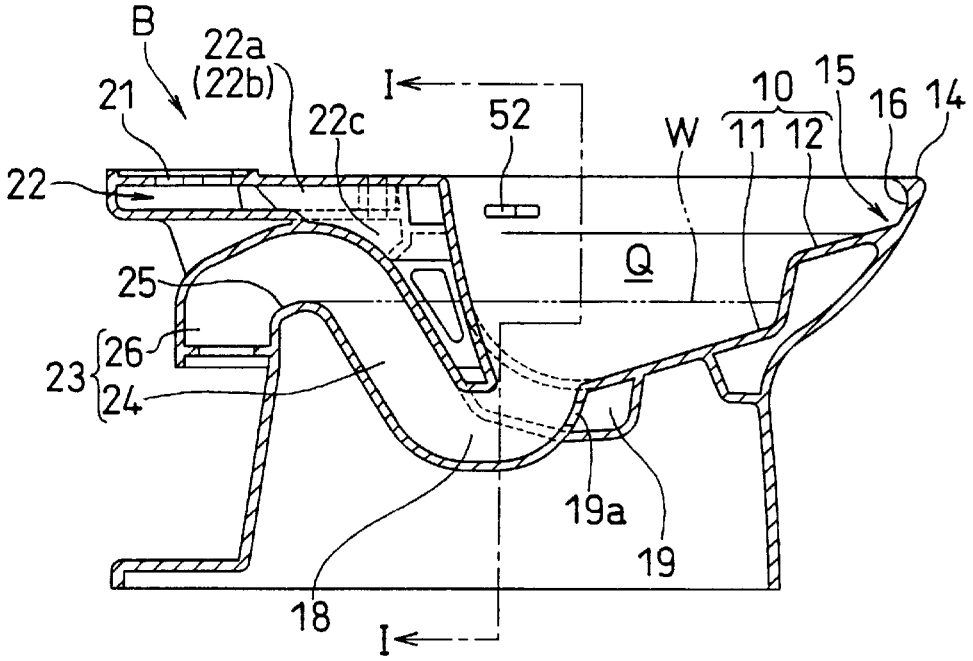
FIG. 21 is a longitudinally sectional view showing a flush toilet according to a fourth embodiment of the present invention.
Figure 22:
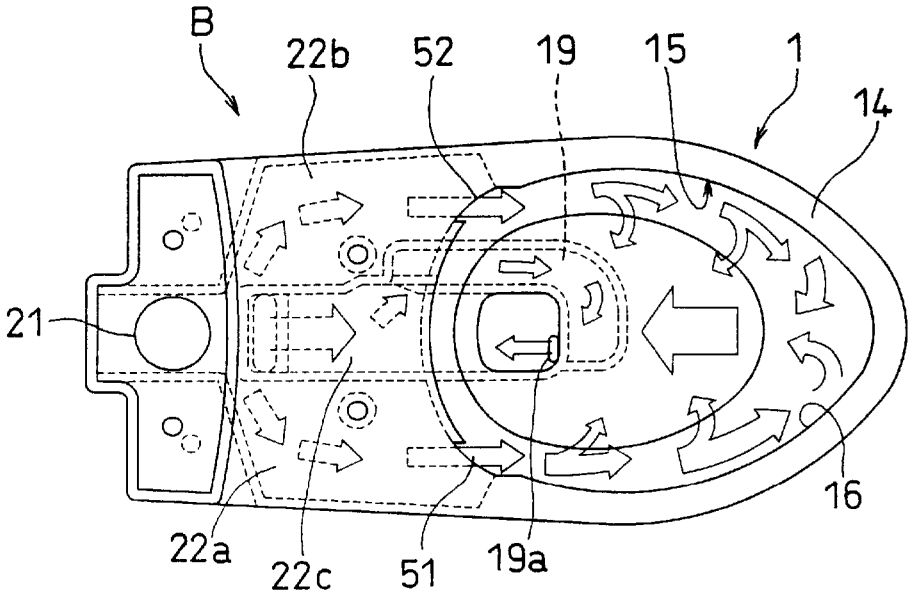
FIG. 22 is a plane view describing showing the flush toilet according to the fourth embodiment of the present invention.
Figure 23:
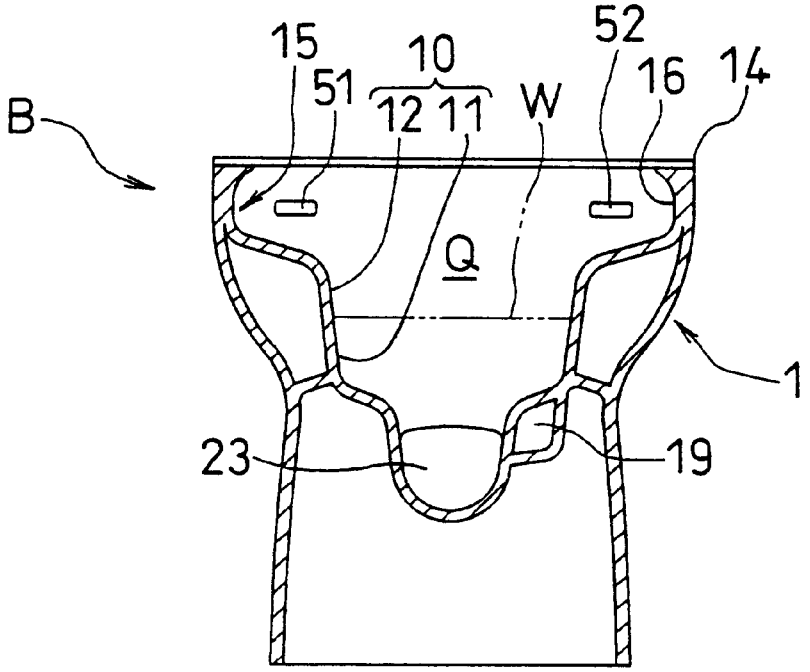
FIG. 23 is a sectional view of the flush toilet taken along line I—I of FIG. 21.

More specifically, as shown in FIGS. 21 and 22, the water passage 22 communicating with the flush water supply hole 21 is configured such that it comprises a left branch passage 22*a* and a right branch passage 22*b*, which are branched therefrom, when looked from above, and a downwardly extending passage 22*c* for flowing flush water downwardly. To an intermediate side wall of the downwardly extending passage 22*c* is coupled a base end of the flush water jet passage 19 having a flush water jet hole 19*a* as an opening in the position opposite to and facing the drain path inlet 18.

Moreover, on the left and right sides of the inner rim wall surface section 15 of the rim portion constituting the interior side of the bowl section 1 are provided flush water discharge outlets 51 and 52 in a spaced relationship apart in a predetermined distance. Further, the flush water discharge outlets 51 and 52 are coupled to the left and right branch passages 22*a* and 22*b*, respectively. With this configuration, the flush water discharged from the left and right flush water discharge outlets 51 and 52 can wash the waste receipt surface section while circulating the flush water in opposite directions along the flush water passage 16. Further, the flush water circulating in the opposite directions is caused to be combined together substantially in the center portion of the front end side (the right end side in the drawing) of the bowl section 1 and to flow toward the water chamber W. As this configuration can shorten the distance which the flush water circulates at the periphery of the bowl section 1, the pressure of discharging the water can be reduced, thereby preventing the flush water from splashing outside over the flush water passage 16. It is further to be noted herein that, although the flush water passage 16 is not shaped in an overhanging form for the flush toilet of this embodiment, the flush water passage 16 can be shaped in an overhanging form in order to ensure a prevention of splashing the flush water outside over the flush water passage 16.

Furthermore, for the flush toilet according to this embodiment, the flush water can act as forcing a waste product in the water chamber W directly into the drain path inlet 18 from the flush water jet passage 19 through the flush water jet hole 19*a*, even if the pressure of the flush water would be low. Therefore, the flush toilet of this embodiment can ensure a sufficiently high performance of discharging the waste product.

In addition, the flush toilet B according to the fourth embodiment has the drain path 23 disposed so as for its rear end portion to be exposed to the outside of the main body of the flush toilet. This configuration allows the flush toilet to be mounted simply by connecting an adjuster pipe (not shown) in an appropriate way, without conducting a floor construction which requires a current position of a drain pipe, for instance, upon reconstructing a toilet. It is to be noted herein that, as the other configurations and the action of the siphon for discharging the waste product outside the flush toilet are substantially identical to those of the flush toilet according to the first embodiment, a duplicate explanation is omitted from the following description.

(Fifth Embodiment)

Figure 24:
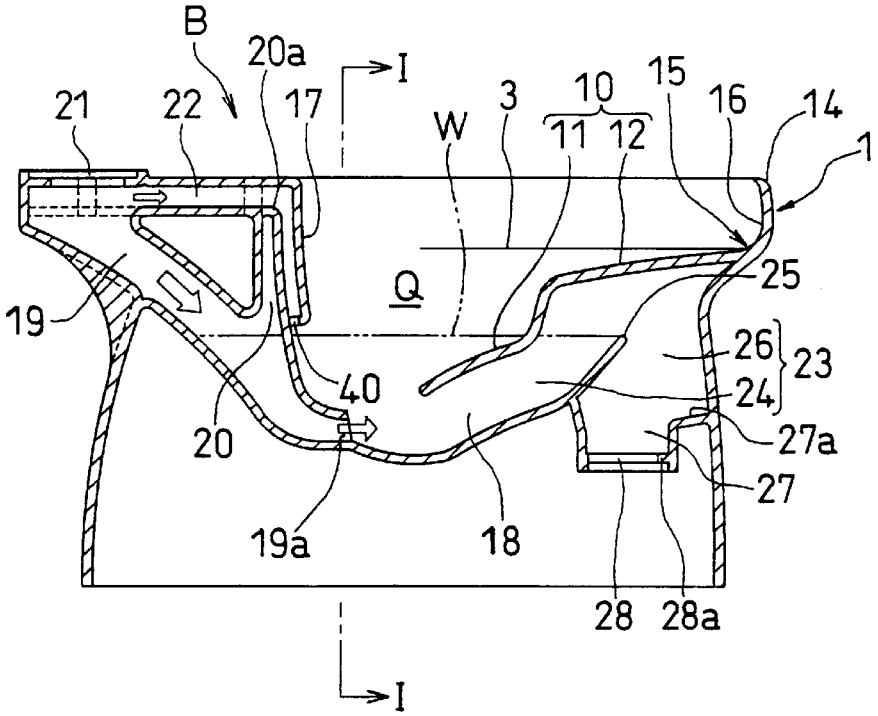
FIG. 24 is a longitudinally sectional view showing a flush toilet according to a fifth embodiment of the present invention.
Figure 25:
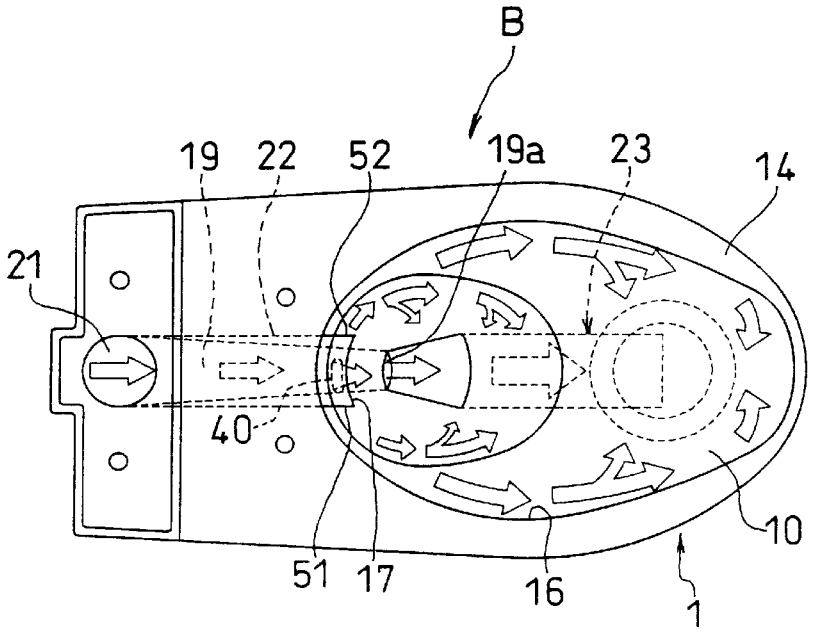
FIG. 25 is a plane view showing the flush toilet according to the fifth embodiment of the present invention.
Figure 26:
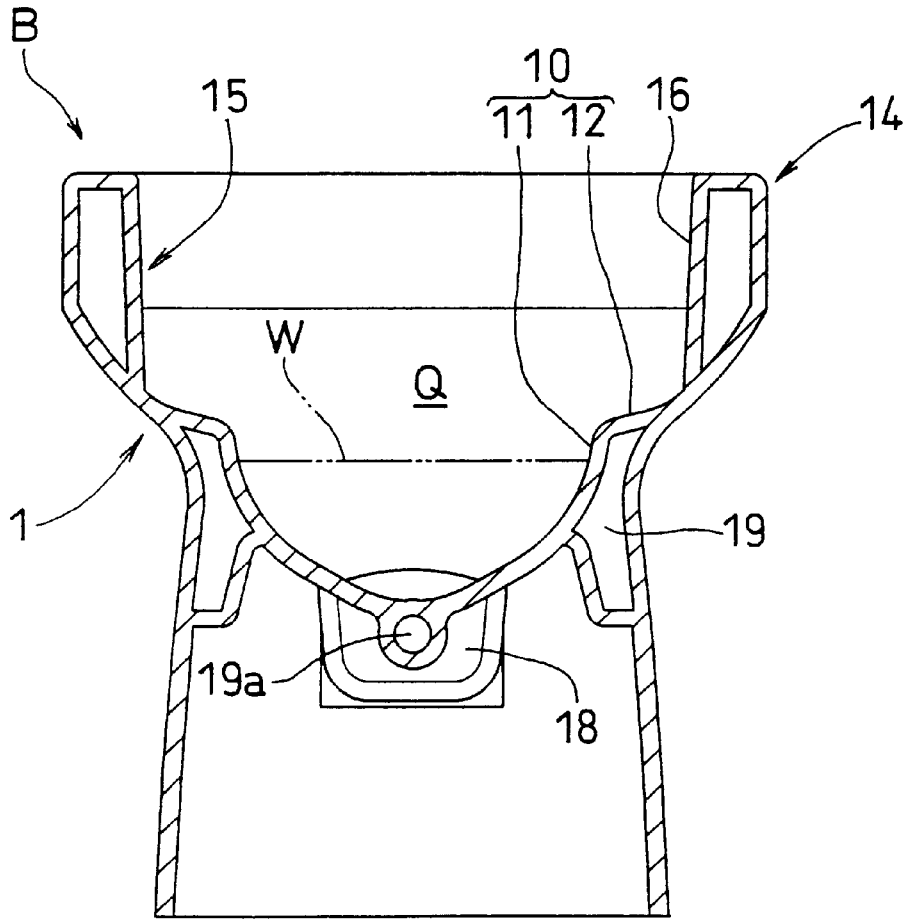
FIG. 26 is a sectional view of the flush toilet taken along line I—I of FIG. 24.

A description will then be made of the flush toilet B according to the fifth embodiment of the present invention with reference to FIGS. 24 to 26. The flush toilet of this embodiment is of a siphon jet type which can be operated in substantially the same manner as that of the fourth embodiment. For the flush toilet of the previous embodiment, the drain path 23 of a reverse trap type is disposed on the rear side of the bowl section 1. On the other hand, the flush toilet of this embodiment is of a front trap type, in which the drain path 23 is disposed on the front side of the bowl section 1. Further, for the flush toilet of this embodiment, the forced flush water discharge outlet 40 is disposed in substantially the same manner as for the flush toilet of the third embodiment. It can be noted that the flush toilet B of this embodiment is described by providing the identical structuring elements with the same reference numerals as the flush toilet of the first embodiment.

As shown in FIGS. 24 and 25, the flush toilet B according to this embodiment has the projection portion 17 communicating with the water passage 22 disposed on the interior side of the inner rim wall surface section 15 of the rim portion in the same manner as for the flush toilet of the third embodiment. The projection portion 17 is provided with the transversely discharging opening 5 on each of the left and right sides thereof and with the forced flush water discharge outlet 40 at the lower end thereof. Therefore, the flush toilet of this embodiment allows the transversely discharging openings 5 and 5 to discharge flush water in opposite directions along the flush water passage 16 in substantially the same manner as the flush water discharge outlets 51 and 52 (as shown in FIG. 21) of the flush toilet according to the fourth embodiment. Further, the flush toilet of this embodiment enables the forced flush water discharge outlet 40 to discharge flush water in a generally vertical direction toward the water chamber W, and a waste product to be forced into the drain path 23 in substantially the same manner as the flush toilet of the third embodiment.

Moreover, the flush water supply hole 21 is provided with the flush water jet passage 19 which can flow the flush water downwardly in an amount larger than the water passage 22 communicating with the transversely discharging opening 5 and the forced flush water discharge outlet 40, and the flush water jet passage 19 is in turn provided with a flush water jet hole 19*a* in the position opposite to the drain path inlet 18.

Furthermore, the flush water jet passage 19 is provided with a secondary water passage 20 extending upward from the intermediate position thereof so as to communicate with the water passage 22. The secondary passage 20 is disposed so as to have the action of ventilating air therefrom.

In addition, as shown in FIG. 26, the flush water passage 16 has the left and right sides of the inner rim wall surface section 15 of the rim portion formed each as a generally vertical surface, when looked from above, and a portion near to the front end side (the right end portion in the drawing) of the bowl section 1 corresponding to the projection portion 17 is shaped in a gradually overhanging form. It is noted herein that the other configurations and the action of a siphon for discharging a waste product outside the flush toilet are substantially identical to those of the flush toilet of the first embodiment so that a duplicate description is omitted from the following explanation.

As the flush toilet of this embodiment is configured in the manner as described above, the flush water is discharged from the forced flush water discharge outlet 40 in a generally vertical direction toward the water chamber W when the flush water has been supplied after spools, and the flush water forces the waste product excreted in the water chamber W into the drain path 23. On the other hand, the flush water from the two transversely discharging openings 5 and 5 washes the waste receipt surface section while circulating about the flush water passage 16 in opposite directions. The flush water is then combined together in the center on the front end side (the right end side in the drawing) of the bowl section 1 and then flows toward the water chamber W. Further, the flush water from the flush water jet hole 19a can act as forcing the waste product present in the water chamber W directly into the drain path inlet 18 so that the flush toilet can ensure a sufficiently high level of discharging the waste product.

Further, as the flush toilet of this embodiment is configured such that the amount of the flush water from the flush water jet passage 19 becomes larger than the water passage 22, the flush water from the flush water supply hole 21 reaches the flush water jet passage 19 almost directly, and a tank head can be obtained to a sufficient extent. This can wash the flush toilet in an efficient way and improve the effect of saving water usage. On the other hand, the rate of the amount of the water coming to the water passage 22 can be controlled at a smaller level so that the pressure of water in the transversely discharging openings 5 and 5 becomes lower and the flush water can be prevented from being splashed outside from the flush water passage 16 outside over the main body of the flush toilet. Moreover, even if the pressure of discharging the flush water is low, the waste receipt surface section can be washed to a sufficient extent because the flush water is circulating in both directions to the left and right.

Furthermore, as the flush water is supplied, the forced flush water discharge outlet 40 is allowed to be located under the water of the water chamber W due to a rise in the water level of the water chamber W because the forced flush water discharge outlet 40 is disposed in the position close to the water level of the water chamber W. This configuration can prevent the flush water from splashing.

Additionally, as the secondary water passage 20 having the air vent function is provided, no noise is caused to occur due to the fact that the flush water swallows air up upon washing. Therefore, the flush toilet of the present invention can be washed at the possible lowest level of noise.

It is further noted herein that an angle of inclination of the overhanging portion of the flush water passage 16 may be set in an appropriate way and that the flush water passage 16 may be shaped in an overhanging form at its entire periphery.

INDUSTRIAL UTILIZATION

The flush toilet according to the present invention is configured in the manner as described above and can be practiced in the aspects as described above. Therefore, the flush toilet according to the present invention can achieve the effects as will be described hereinafter.

The flush toilet according to the present invention is provided with a discharging means for discharging the main stream of the flush water so as to expand and disperse over an upper periphery of the toilet along the inner wall surface section of the periphery of the toilet, a flush water passage disposed so as to guide the main stream of the flush water discharged from the discharging means, and a water passage disposed so as to expand and disperse a branch stream branched from the main stream thereof over a substantially entire area of the inner surface section of the bowl section, in which the flush water passage is formed as the inner rim wall surface section of the rim portion disposed at the periphery of the upper opening of the bowl section and the water passage is formed as the waste receipt surface section disposed continuously with the inner rim wall surface section of the rim portion. This configuration can prevent a common boundary between the waste receipt surface section and the rim portion from being formed as a dead angle, when looked from above, and further offer effects in that the common boundary section can be coated with glaze with certainty upon manufacturing flush toilets and that the flush toilet can be washed easily and kept clean.

Further, the flush toilet according to the present invention is configured such that the flush water passage is shaped in an overhanging form so as to allow the inner rim wall surface section of the rim portion to incline and hang over inside the bowl section at an entire periphery or a peripheral portion thereof. The overhanging form of the flush water passage can offer an effect, in addition to the effects as described above, in that the flush water can be prevented for sure from splashing outside over the main body of the flush toilet.

Furthermore, the flush toilet according to the present invention is configured such that the inner rim wall surface section of the rim portion is provided with the flush water discharge section for discharging flush water so as to flow along the flush water passage. Therefore, the flush toilet according to the present invention can offer an effect, in addition to the effects as described above, in that, for example, the rim rinse waterway and the flush water discharge hole to be disposed at the lower side surface section of the rim rinse waterway, which are otherwise required to be disposed for conventional flush toilets, are not required any longer and the steps of manufacturing flush toilets can be simplified, thereby improving efficiency of shaping the flush toilets upon manufacturing. Further, the flush toilet according to the present invention can offer effects in that the flush water can be allowed to circulate along the inner rim wall surface section of the rim portion, and wash a wide area over the entire area of the waste receipt surface section.

Moreover, the flush toilet according to the present invention is configured such that the flush water discharge section is disposed in the interior of the bowl section and the flush water passage in an overhanging form is disposed in the position opposite to and facing the flush water discharge section. This can offer an effect, in addition to the effects as described above, in that the flush water discharged from the flush water discharge section causes no risk of splashing outside over the flush toilet because the portion of the bowl section having the largest curvature is in such an overhanging form even if the flush water expands and disperses in a wider area of the bowl section as it flows farther apart from the flush water discharge section. The flush toilet according to the present invention can further offer an effect in that the steps of manufacturing the flush toilet can be carried out in a more simplified way because only the rim portion with the overhanging surface section can be formed by a split mold while the portions other than the rim portion can be formed by the same mold as the bowl section.

The flush toilet according to the present invention is further configured such that the flush water discharge section is provided with two flush water discharge outlets at different positions so as to discharge the flush water in opposite directions along the flush water passage. The flush toilet of this configuration can offer an effect, in addition to the effects as described above, in that it can prevent the flush water for sure from splashing outside over the flush toilet because the distance of circulation of the flush water can become so short that the pressure of discharging the flush water can be reduced.

The flush toilet according to the present invention is furthermore configured such that the forced flush water discharge outlet is provided in the position above the drain path inlet disposed in the bottom portion of the bowl section and above the water level near to the water level of the water chamber in the bowl section. This configuration can promote a flow of the flush water into the drain path inlet from the flush water passage and can offer an effect, in addition to the effects as described above, in that a waste product floating in the flush water passage can be discharged by a small amount of the flush water so that the flush toilet can save the usage of flush water in a more efficient way.

Moreover, the flush toilet according to the present invention is configured in such a manner that a flush water jet hole for jetting flush water toward the drain path inlet disposed in the bottom portion of the bowl section is provided. Therefore, this configuration can offer an effect, in addition to the effects as described above, in that the pressurized discharging of the flush water and the waste product to the drain path can be promoted and the usage of the flush water can be saved to a further extent.

Furthermore, the method for washing the toilet according to the present invention can offer an effect in that the main stream of the flush water in association with the branch stream branched from the main stream thereof is arranged so as to expand and disperse over the entire area of the inner surface portion of the toilet bowl section, thereby discharging the floating waste product with a small amount of the flush water without splashing the flush water outside over the upper edge portion of the toilet.

What is claimed is:

1. A flush toilet characterized by:

a discharging means for discharging a main stream of flush water so as to expand and disperse over a substantially entire upper periphery of the flush toilet along an inner wall surface section of the entire upper periphery of the flush toilet;

a flush water passage (16) for guiding said main stream of flush water from said discharging means; and a water passage (10) formed gradually and continuously with said flush water passage (16), which is arranged so as to expand and disperse a branched stream of the flush water branched from said main stream of flush water over an substantially entire area of an inner surface section of the bowl section.

2. The flush toilet as claimed in claim 1, characterized in that:

said flush water passage (16) is formed as an inner rim wall surface section (15) of the rim portion disposed at a peripheral edge of an upper opening (13) of said bowl section (1); and said flush passage (10) is formed as a waste receipt surface section disposed continuously with said inner rim wall surface section (15) of the rim portion.

3. The flush toilet as claimed in claim 2, characterized in that said flush water passage (16) is formed in an overhanging form inclining so as to hang over an entire periphery or a portion of the periphery of said inner rim wall surface section (15) of the rim portion inside said bowl section (1).

4. The flush toilet as claimed in claim 2, characterized in that said inner rim wall surface section (15) of the rim portion is provided with a flush water discharge section for discharging flush water so as to flow along said flush water passage (16).

5. The flush toilet as claimed in claim 3, characterized in that:

said flush water discharge section is disposed on an interior side of said bowl section (1); and said flush water passage (16) in an overhanging form is disposed in a position opposite to and facing said water discharge section.

6. The flush toilet as claimed in claim 4, characterized in that said water discharge section is provided with two flush water discharge outlets (51) and (52) in different positions so as to allow flush water discharged therefrom to flow in opposite directions along said flush water passage (16).

7. The flush toilet as claimed in claim 2, characterized in that a forced flush water discharge outlet (40) is disposed in a position above a drain path inlet (18) disposed in a bottom portion of said bowl section (1) and above yet close to a water level of a water chamber of said bowl section (1) so as to promote a flow of the flush water from said flush water passage (16) into said drain path inlet (18).

8. The flush toilet as claimed in claim 2, characterized in that a flush water jet hole **(19*a*) is disposed for jetting flush water toward said drain path inlet (18) disposed in a bottom portion of said bowl section (1)**.

9. A method of washing a toilet wherein flush water is dispersed over an entire area of an inner surface section of a bowl section by a main stream of flush water and a branch stream of the flush water branched off from said main stream thereof, without causing the flush water to fail to splash outside over an upper edge portion of the toilet.

10. The method of washing the toilet as claimed in claim 9, wherein:

said main stream of flush water is flown so as to expand and disperse over a substantially entire area of an upper edge of an inner wall surface section of the upper edge portion of the toilet without causing the flush water to splash outside over said upper edge portion thereof; and the branch stream of the flush water branched off from said main stream thereof is guided so as to expand and disperse over an entire area of an inner surface section of the bowl section of the toilet; and the flush water is then led to a drain path inlet.

* * * * *